US006862963B2

(12) United States Patent
Habermehl et al.

(10) Patent No.: US 6,862,963 B2
(45) Date of Patent: Mar. 8, 2005

(54) SPLIT NOSEPIECE FOR DRIVING COLLATED SCREWS

(75) Inventors: G. Lyle Habermehl, 436 Calvert Dr., Gallatin, TN (US) 37006; Brandon Lyle Habermehl, Gallatin, TN (US); Troy D. Hale, Hendersonville, TN (US)

(73) Assignee: G. Lyle Habermehl, Gallatin, TN (US)

( * ) Notice: Subject to any disclaimer, the term of this patent is extended or adjusted under 35 U.S.C. 154(b) by 17 days.

(21) Appl. No.: 10/291,248

(22) Filed: Nov. 8, 2002

(65) Prior Publication Data

US 2004/0089118 A1 May 13, 2004

(51) Int. Cl.[7] ..... B25B 23/06
(52) U.S. Cl. ..... 81/434; 227/136
(58) Field of Search ..... 81/434, 57.37, 81/433, 435, 57.23, 57.39; 227/136, 125, 126, 135

(56) References Cited

U.S. PATENT DOCUMENTS

| | | | | |
|---|---|---|---|---|
| 3,920,169 A | | 11/1975 | DeCaro | |
| 4,018,254 A | | 4/1977 | DeCaro | |
| 4,062,388 A | | 12/1977 | DeCaro | |
| 4,146,071 A | | 3/1979 | Mueller et al. | |
| 4,404,877 A | | 9/1983 | Mizuno et al. | |
| 5,186,085 A | | 2/1993 | Monacelli | |
| 5,284,074 A | | 2/1994 | Chen | |
| 5,568,753 A | * | 10/1996 | Habermehl et al. | 81/434 |
| 5,819,609 A | | 10/1998 | Habermehl | |
| 5,826,468 A | | 10/1998 | Daubinger et al. | |
| 5,870,933 A | | 2/1999 | Habermehl | |
| 5,927,163 A | * | 7/1999 | Habermehl et al. | 81/434 |
| 5,934,162 A | * | 8/1999 | Habermehl | 81/434 |
| 6,055,891 A | | 5/2000 | Habermehl | |
| 6,089,132 A | * | 7/2000 | Habermehl | 81/434 |
| 6,123,244 A | | 9/2000 | Huang | |
| 6,212,980 B1 | | 4/2001 | Kratch et al. | |
| 6,227,429 B1 | | 5/2001 | Huang | |
| 6,244,140 B1 | * | 6/2001 | Habermehl | 81/434 |
| 6,425,306 B1 | | 7/2002 | Habermehl | |
| 6,453,780 B2 | * | 9/2002 | Habermehl | 81/434 |
| 6,601,480 B1 | * | 8/2003 | Habermehl | 81/434 |

FOREIGN PATENT DOCUMENTS

WO WO 02/11952 2/2002

OTHER PUBLICATIONS

Quik Drive "Screwdrivers Attachment" for Model Nos. 3301 & 3303.

* cited by examiner

*Primary Examiner*—David B. Thomas
(74) *Attorney, Agent, or Firm*—Dorsey & Whitney LLP

(57) ABSTRACT

A novel workpiece engaging nose body for holding a screwstrip having screws held in a strap is provided. The workpiece engaging nose body includes a nose portion and a rear portion with the nose portion slidably mounted on the rear portion for movement rearwardly when the nose is urged into a workpiece to drive a screw. An exitway is defined between the nose portion and rear portion through which spent strap from which screws have been driven exit the nose body. On urging the nose body into the workpiece, the nose portion slides rearwardly to engage the strap in the exitway and move it rearwardly into engagement with the rear portion in the exitway. The strap is preferably "pinched" in the exitway between the nose portion and rear portion to assist in locating a screw to be driven from the nose body.

32 Claims, 20 Drawing Sheets

22
20
117
24
410
408
402
404
422
432
422
426
406

FIG. 18
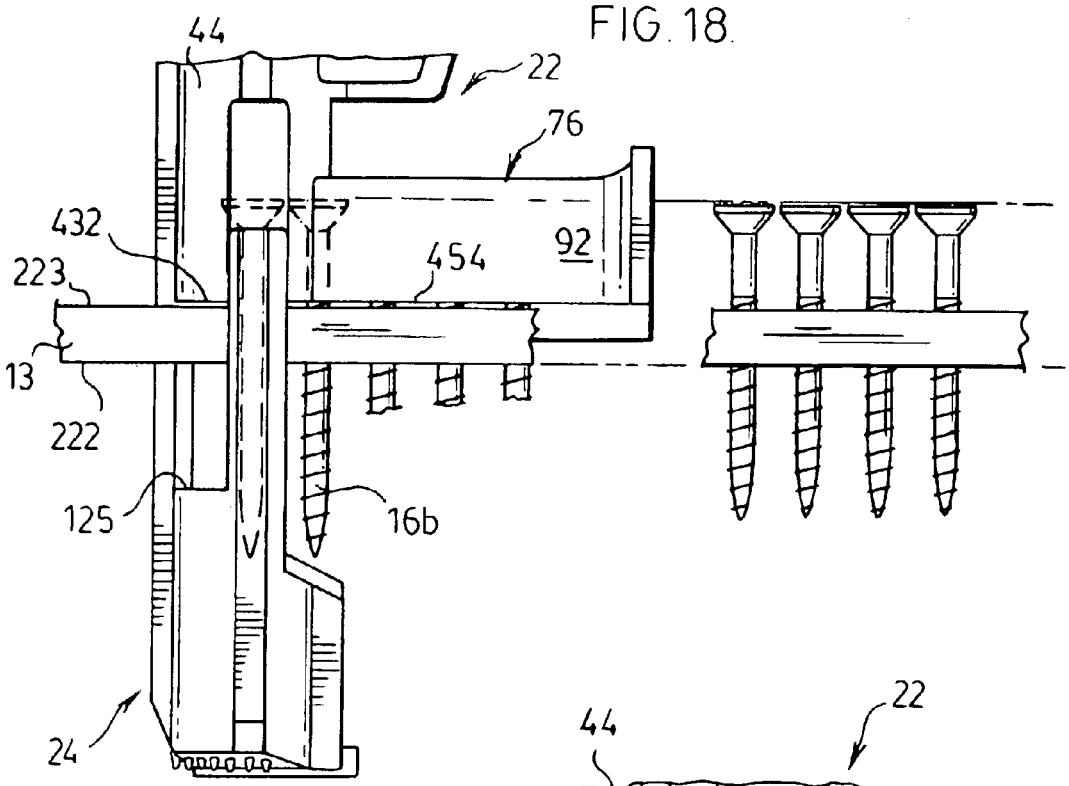
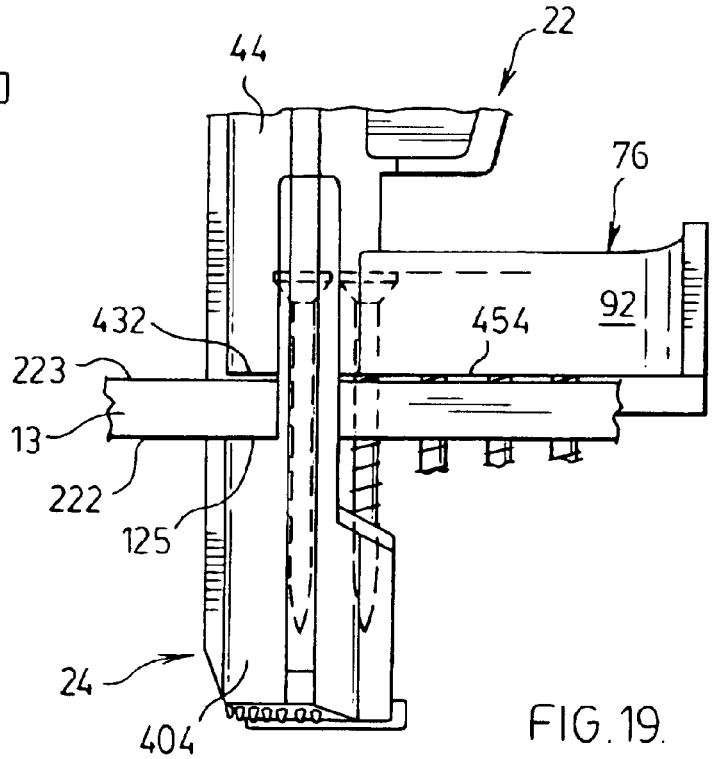
FIG. 19

SPLIT NOSEPIECE FOR DRIVING COLLATED SCREWS

SCOPE OF THE INVENTION

This invention relates to autofeed screwdrivers and, more particularly, to an autofeed screwdriver adapted to drive a variety of different size screws collated in a screwstrip.

BACKGROUND OF THE INVENTION

Previously known autofeed screwdrivers suffer the disadvantage that they must be adjusted or modified so as to be able to drive screws of considerably varying lengths. Previously known autofeed screwdrivers utilize a number of different mechanisms to hold the screw and/or strap of a screwstrip so as to locate a screw to be driven and supporting the spent strap on a forward surface of an exitway. However, previously known devices suffer the disadvantage that they do not utilize a combination of these features in a tool adapted to drive screws of different lengths.

Previously known devices suffer the disadvantage that the spent strap exiting from the tool is only engaged on a forwardly directed surface of the spent strap.

Another disadvantage with previously known devices is that some screwstrips have their straps located at different distances from their heads than other screwstrips. The relative position of the strap on the screw typically has been greater for screws such as 3 inch and 3½ inch lengths than with shorter screws. This arises since it is advantageous to have a strap for longer screws closer to a mid-point along the length of the screws to assist in stabilizing the screws held in the strap, however, this presents difficulties in adapting a tool to drive screwstrips with straps at different distances from the heads of the screws.

Another disadvantage with previously known devices is that they do not permit holding the screwstrip both by engagement of the next screw to be driven and support of the spent strip on a forward surface in the exitway.

Another disadvantage is that known devices do not provide a useful mechanism for driving screwstrips carrying indexing mechanisms on the strap.

SUMMARY OF THE INVENTION

To at least partially overcome these disadvantages of the previously known devices, the present invention provides an autofeed screwdriving tool to drive screws of different lengths.

Another object is to provide an autofeed screwdriving tool which is adapted to drive screws of considerably greater lengths without adjustment, change or modification of the tool.

Another object is to provide an autofeed screwdriving tool to drive screws from collated screwstrips in which the spent strap from the screwstrip is pinched between upper and lower surfaces of an exitway while a screw is being engaged and driven.

Another object is to provide an autofeed screwdriving tool to drive collated screws from a screwstrip in which a screwstrip is held both by the next screw to be driven being engaged and by the spent strap being supported.

Another object is to provide an autofeed screwdriving tool to drive collated screws from a screwstrip in which indexing mechanisms are provided on the strap of the screwstrip.

Another object is to provide a screwstrip having a strap with a rear surface of the strap disposed at a constant distance forward of the heads of the screws.

Another object is to provide a screwdriver assembly to drive with a power driver, threaded screws from a screwstrip comprising screws collated together on a strap spaced in generally parallel relation from each other, the screwdriver comprising:

a housing;

an elongate drive shaft for operative connection to a power driver for rotation thereby and defining a longitudinal axis;

a slide body coupled to the housing for displacement parallel to the axis of the drive shaft between a forwardmost extended position and a retracted position;

the slide body resiliently biased forwardly relative to the housing parallel the axis, the slide body comprising:

a guideway to receive a screw coaxially therein, a screwstrip entranceway opening generally radially into the guideway on a first side thereof, and a strap exitway opening generally radially out of the guideway on a second side thereof opposite the entranceway, the guideway, the entranceway and the exitway juxtapositioned to permit a screwstrip comprising screws collated on a strap spaced in generally parallel relation from each other to be advanced through the entranceway radially into the guideway to locate each successive screw coaxially within the guideway with a portion of the strap from which screws have been driven extending from the guideway through the exitway, the slide body having a rear portion and a forward nose portion, the nose portion coupled to the rear portion for displacement parallel to the axis of the drive shaft between a forward position and a rear position;

the nose portion resiliently biased forwardly relative to the rear portion parallel the axis;

the rear portion having an elongate guide channel for said screwstrip extending through said rear portion generally transverse to the longitudinal axis and opening into the guideway via the entranceway, the guide channel having a cross-section closely corresponding at least in part to that of the screwstrip received therein to constrain the strap and screws received therein against substantial movement other than longitudinally along the channel, the driver shaft having at a forward end a bit, the shaft relatively reciprocally movable axially in the guideway to engage with the bit a screw disposed coaxially within the guideway and drive the screw axially forwardly from the guideway into a workpiece, the rear portion carrying an axially, forwardly directed rear strap support surface axially in line with the exitway rear of the strap, the rear strap support surface forming a rearwardmost perimeter of the exitway, the nose portion carrying an axially, rearwardly directed forward strap support surface axially in line with the exitway forward of the strap, the strap support surface forming a forwardmost perimeter of the exitway, wherein on sliding of the nose portion relative the rear portion towards the rear position, the strap in the exitway is engaged by the forward strap support surface and urged rearwardly into engagement with the rear strap support surface.

In one aspect, the present invention provides a screwdriver assembly to drive with a power driver, threaded screws from a screwstrip comprising screws collated together on a strap spaced in generally parallel relation from each other, the screwdriver comprising:

a housing;

an elongate drive shaft for operative connection to a power driver for rotation thereby and defining a longitudinal axis;

a slide body coupled to the housing for displacement parallel to the axis of the drive shaft between a forwardmost extended position and a retracted position;

the slide body resiliently biased forwardly relative to the housing parallel the axis, the slide body comprising:

a guideway to receive a screw coaxially therein, a screwstrip entranceway opening generally radially into the guideway on a first side thereof, and a strap exitway opening generally radially out of the guideway on a second side thereof opposite the entranceway, the guideway, the entranceway and the exitway juxtapositioned to permit a screwstrip comprising screws collated on a strap spaced in generally parallel relation from each other to be advanced through the entranceway radially into the guideway to locate each successive screw coaxially within the guideway with a portion of the strap from which screws have been driven extending from the guideway through the exitway, the slide body having a rear portion and a forward nose portion, the nose portion coupled to the rear portion for displacement parallel to the axis of the drive shaft between a forward position and a rearward position;

the nose portion resiliently biased forwardly relative to the rear portion parallel the axis;

the rear portion having an elongate guide channel for said screwstrip extending through said rear portion generally transverse to the longitudinal axis and opening into the guideway via the entranceway, the guide channel having a cross-section closely corresponding at least in part to that of the screwstrip received therein to constrain the strap and screws received therein against substantial movement other than longitudinally along the channel, the driver shaft having at a forward end a bit, the shaft relatively reciprocally movable axially in the guideway to engage with the bit a screw disposed coaxially within the guideway and drive the screw axially forwardly from the guideway into a workpiece, the nose portion carrying an axially, rearwardly directed forward strap support surface axially in line with the exitway forward of the strap, the forward strap support surface forming a forwardmost perimeter of the exitway on sliding of the nose portion relative the rear portion towards the rear position, the guideway extending forwardly through the nose portion and opening forwardly on the nose portion as a forward opening through which each screw is to be driven, a forwardmost touchdown surface proximate the forward opening to engage a workpiece into which a screw is to be driven, a flange on the nose portion extending transversely to the axis adjacent the forward opening, the flange having a rearwardly directed surface located, when a screw to be driven is received in the guideway, axially aligned with a tip of a screw next to the screw to be driven and on rearward movement of the nose portion adapted, if the next screw is of sufficient length, to engage the tip of the next screw to sandwich the next screw axially between the flange and the guide channel of the rear portion and prevent further rearward sliding of the nose portion relative the rear portion.

In accordance with the present invention a novel workpiece engaging nose body for holding a screwstrip having screws held in a strap is provided. The workpiece engaging nose body includes a nose portion and a rear portion with the nose portion slidably mounted on the rear portion for movement rearwardly when the nose is urged into a workpiece to drive a screw. An exitway is defined between the nose portion and rear portion through which spent strap from which screws have been driven exit the nose body. On urging the nose body into the workpiece, the nose portion slides rearwardly to engage the strap in the exitway and move it rearwardly into engagement with the rear portion in the exitway. The strap is preferably "pinched" in the exitway between the nose portion and rear portion to assist in locating a screw to be driven from the nose body.

The nose body is preferably used in combination with a screwstrip having a strap with rear surface disposed at a constant distance forwardly of the heads of the screws such that the rear surface of the strap may be engaged by the rear portion in the exitway to accurately locate the screwstrip in the nose body.

The nose portion may also carry, near a forwardmost surface of the nose portion to engage a workpiece, a rearwardly directed surface which is adapted when the nose portion moves rearwardly relative the rear portion to engage a tip of a screw next to the screw to be driven and "sandwich" the next screw between the nose portion and the rear portion to hold the screwstrip in a desired position to facilitate driving a screw.

Either "pinching" of the spent strap in the exitway or "sandwiching" of the next screw is adequate to locate the screwstrip to drive a screw. Enhanced holding of a screwstrip arises by simultaneously "pinching" and "sandwiching".

The nose body is adapted to drive screws of considerably different lengths by holding screws of longer lengths by "sandwiching" without "pinching" and holding screws of shorter lengths by "pinching" without "sandwiching". An intermediate length screw may be held by simultaneously "sandwiching" and "holding".

Pinching is advantageous to avoid feed drawback by which reciprocating screwstrip feed mechanism may tend to draw the screwstrip backwards when a strap is desired to not be moved.

Pinching is advantageous for use of screwstrips having indexing elements carried thereon for registry in complementary indexing elements in the exitway on the nose portion and/or rear portion.

Further aspects and advantages will become apparent from the following description taken together with the accompanying drawings.

BRIEF DESCRIPTION OF THE DRAWINGS

Further aspects and advantages of this invention will become apparent from the following description taken together with the accompanying drawings in which:

FIG. 18 is a front cross-sectional view of the slide body in a position as in FIG. 14 but with 1½ inch screws;

FIG. 19 is a front cross-sectional view similar to that in FIG. 18, however, with the nose portion in a rearward position as in FIG. 11;

DETAILED DESCRIPTION OF THE DRAWINGS

Driver Attachment

Figure 1:
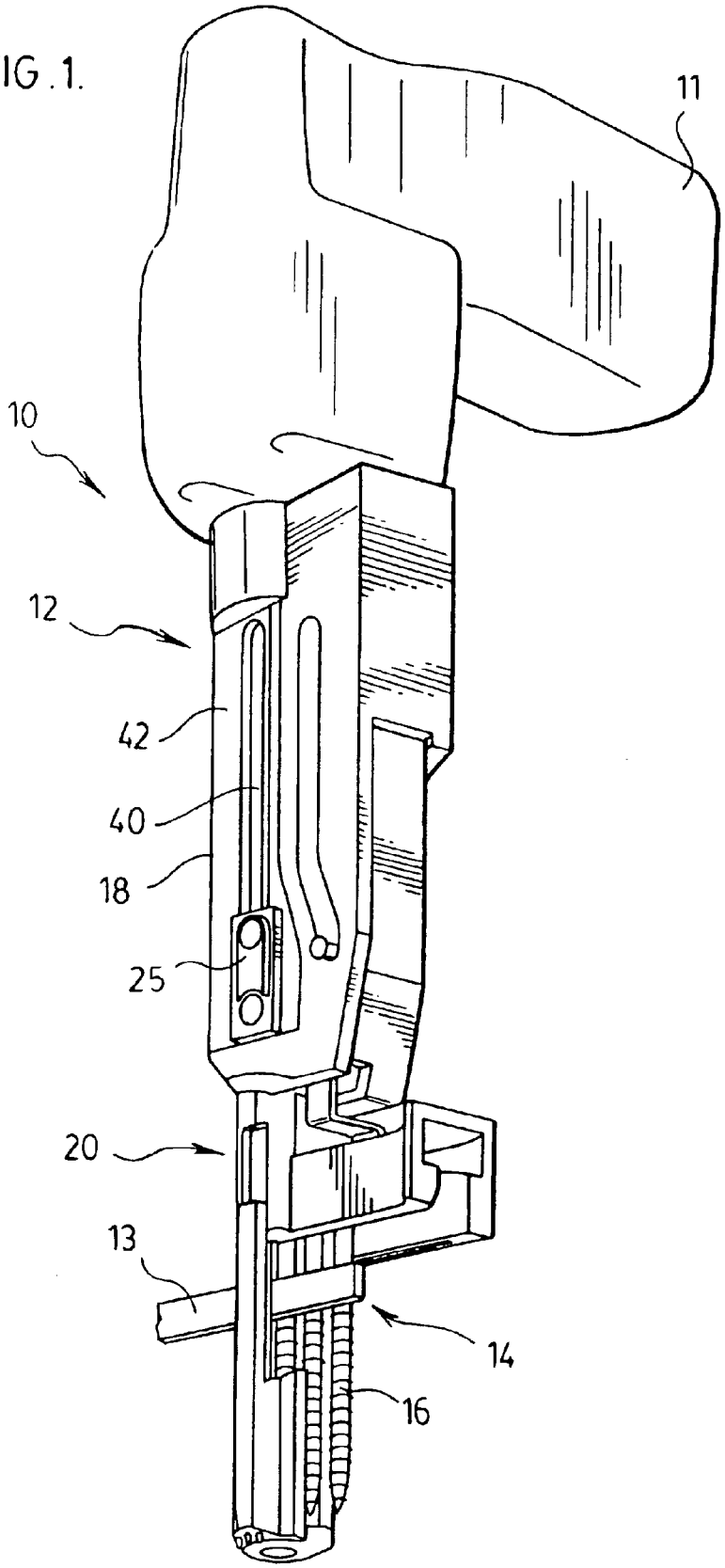
FIG. 1 is a pictorial view of a power screwdriver having a driver attachment in accordance with a first preferred embodiment of the present invention.

FIG. 1 which shows a complete power screwdriver assembly 10 in accordance with the present invention. The assembly 10 comprises the power driver 11 to which a driver attachment 12 is secured. The driver attachment 12 receives a collated screwstrip 14 comprising a plastic strap 13 and spaced screws 16 held by the strap 13 to be successively driven.

Figure 6:
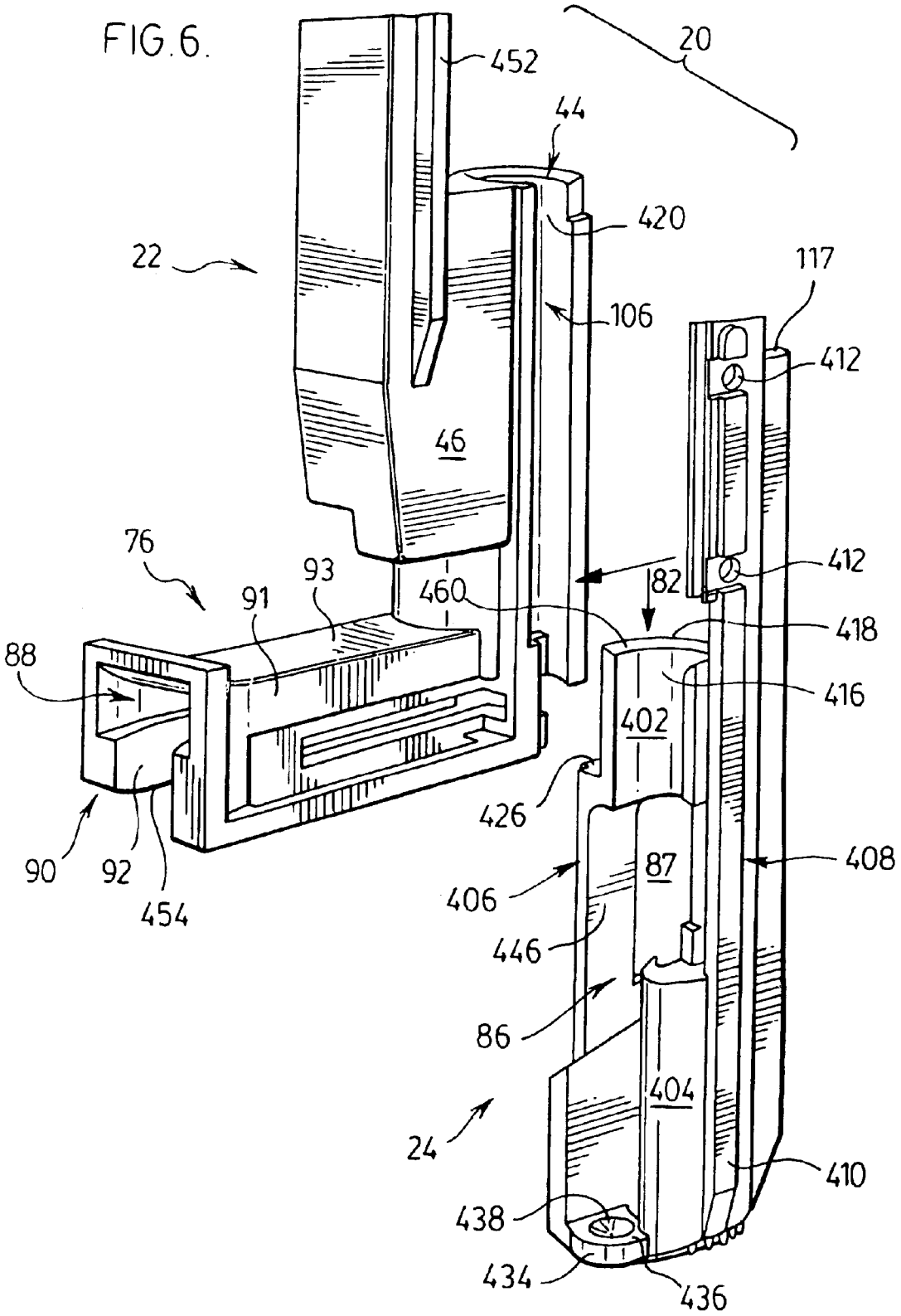
FIG. 6 is a rear exploded pictorial view of the slide body shown in FIG. 3 showing its nose portion and rear portion separately.

The major components of the driver attachment 12 comprise a housing 18 and a slide body 20. The housing 18 is adapted to be secured to a driver housing 30 (only shown in FIG. 4) of a power driver 11 with a chuck 32 of the power driver engaging a driver shaft 34 for rotation of the driver shaft about an axis 52. The slide body 20 is received within the housing 18 for relative sliding parallel the axis 52. The slide body 20 has a nose portion 24 and a rear portion 22 as best seen in FIG. 6. The nose portion 24 has a guideway 82 extending axially therethrough coaxially about the driver shaft 34. The rear portion 22 carries a screw feed channel element 76 providing a channelway 88 which extends radially relative the longitudinal axis 52 to intersect with the guideway 82 and provide a mechanism for screws 16 held in a plastic strap 13 to be successively fed into the guideway 82 into axial alignment with the driver shaft for driving forwardly from the guideway 82 by the bit 122 carried on the forward end of the driver shaft 34. An exitway or exit opening 87 is provided in the slide body 20 to permit spent plastic strap 13 from which screws 16 have been driven to exit from the guideway 82. The exit opening 87 is defined between the nose portion 24 and the rear portion 22. An advance mechanism is provided to successively advance screws into the guideway 82 with each subsequent cycle of retraction of the slide body 20 into the housing 18 so as to drive a screw, and extension of the slide body 20 out of the housing 18 to withdraw the driver shaft 34 rearwardly and advance a new screw into the guideway 82.

Figure 3:
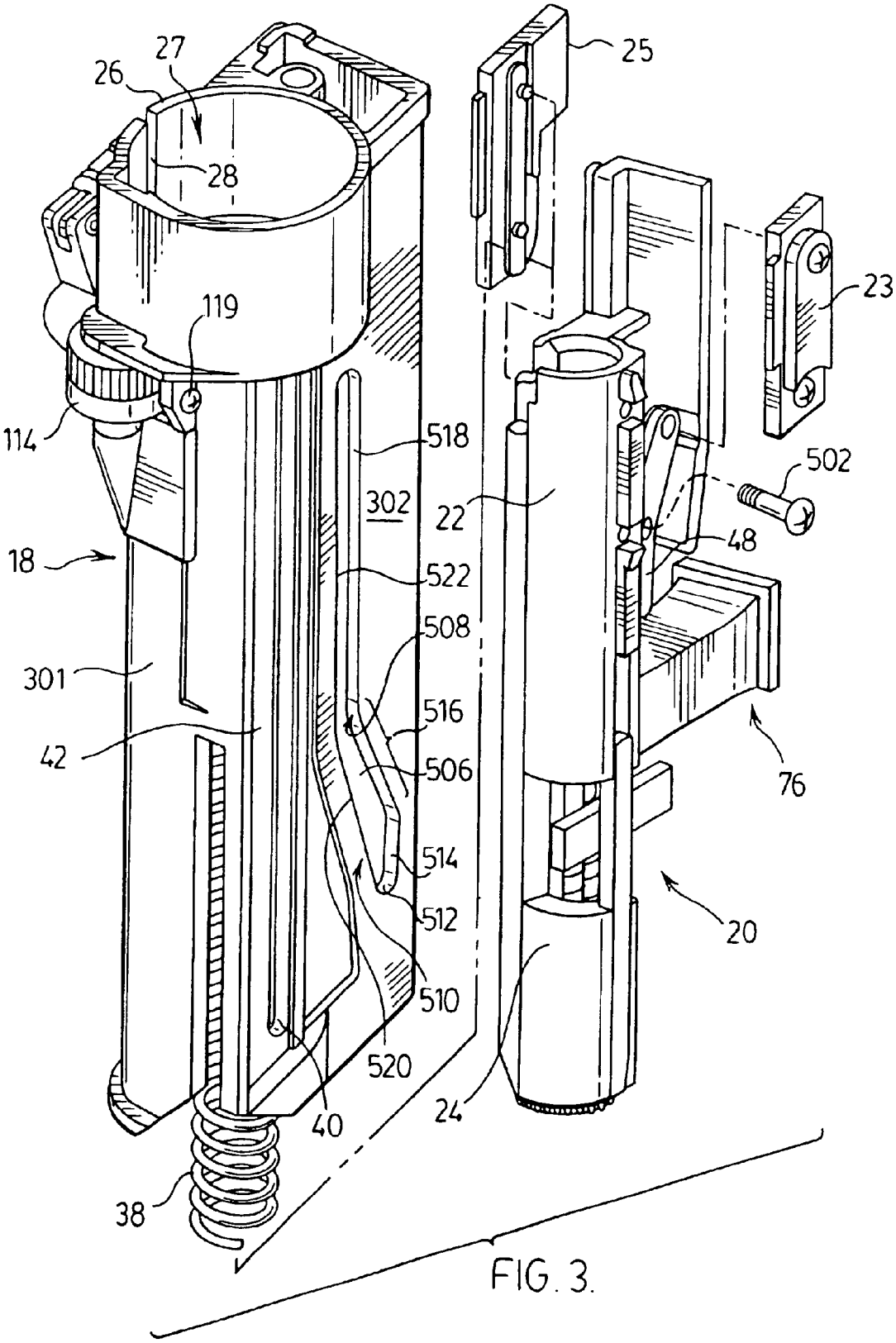
FIG. 3 is an exploded pictorial view of the driver attachment shown in FIG. 1.
Figure 4:
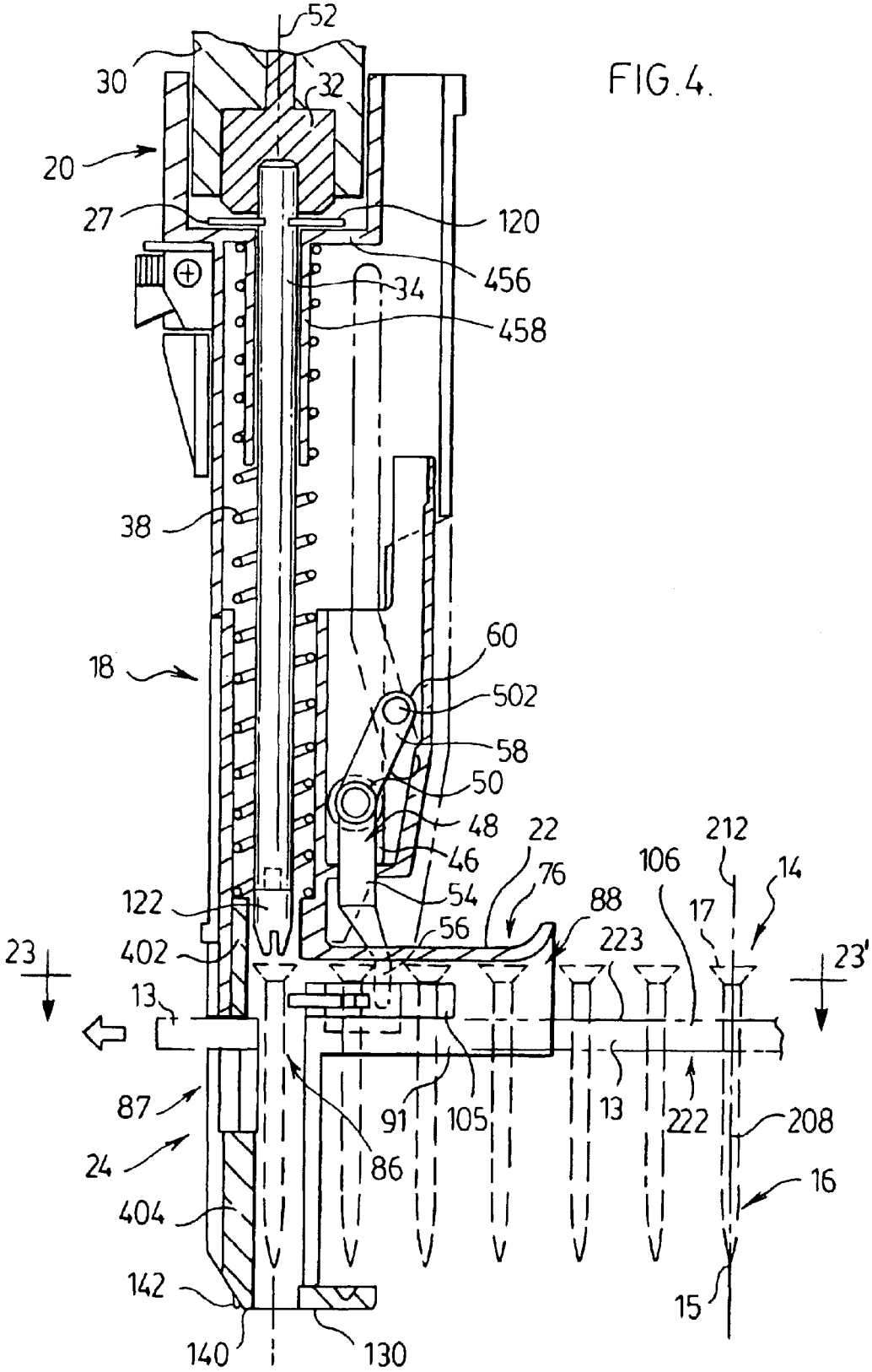
FIG. 4 is a schematic partially cross-sectional view of the driver attachment of FIG. 1 in a fully extended position as seen in FIG. 1 through a plane passing through the longitudinal axis of the drive shaft and centrally of the screws in the screwstrip.
Figure 5:
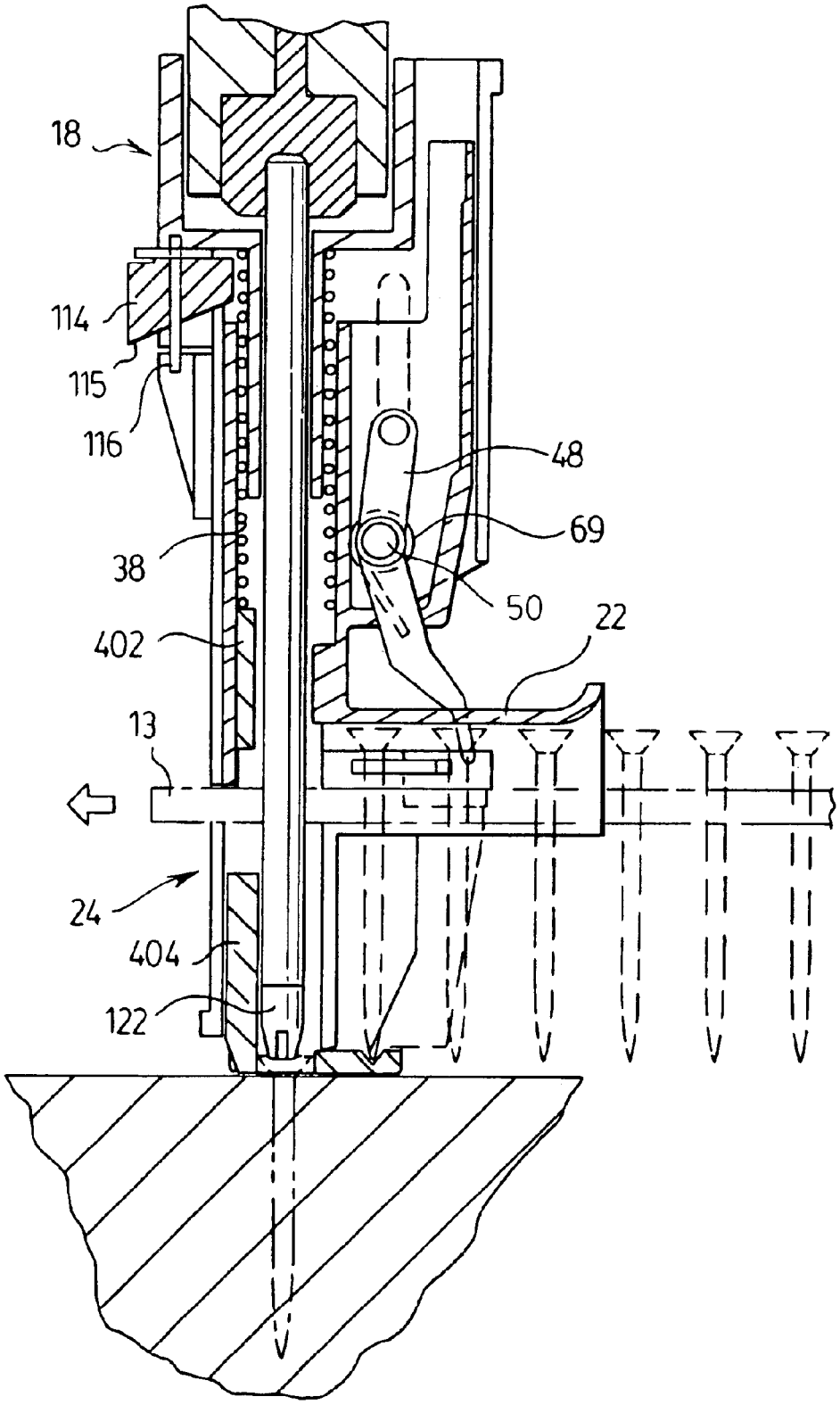
FIG. 5 is a view identical to FIG. 4 but with the driver attachment in a partially retracted position in driving a screw into a workpiece.

Reference is made to FIG. 3 showing an exploded view of major components of the driver attachment 12, namely housing 18 and a slide body 20 comprising a rear portion 22 and a nose portion 24. FIGS. 4 and 5 show in cross-section the interaction of these components.

As seen in FIG. 3, the rearmost end 26 of the housing 18 has a rearwardly directed socket 27 with a longitudinal slot 28 in its side wall to receive and securely clamp the housing 18 onto the driver housing 30 of the power driver 11 so as to secure the housing 18 of the driver attachment to the housing 30 of the power driver against relative movement. The power driver 11 has a chuck 32 rotatable in the driver housing 30 by an electric motor (not shown). The chuck 32 releasably engages the driver shaft 34 in known manner.

As seen in FIG. 4, the slide body 20 is slidably received in the housing 18 with the driver shaft 34 received in a bore passing through the slide body 20. A compression spring 38 disposed between the housing 18 and the slide body 20 coaxially about the driver shaft 34 biases the slide body away from the housing 18 from a retracted position towards an extended position in a manner to be described later in greater detail. As shown, the spring 38 is disposed between the housing 18 and the slide body 20. A first slide stop 23, shown in FIG. 3, is secured to the rear portion 22 of the slide body. A second slide stop 25 is secured to the nose portion 24. Two slide stops 23 and 25 each slide in two longitudinal slots 40 and 41, one on each side of the side walls 42 and 43 of the housing 18 to key each of the nose portion and rear portion to the housing 18 against relative rotation and to independently prevent the nose portion or rear portion being moved forwardly out of the housing 18.

Slide Body

The slide body 20 comprises two principal components, namely, the nose portion 24 and the rear portion 22 which are best seen in an exploded pictorial rear view in FIG. 6 and in an exploded front view in FIG. 5.

The rear portion 22, in effect, comprises a part-cylindrical tubular element 44 from which, on one side, there extends a flange element 46 and a radially extending screw feed channel element 76. The flange 46 is adapted to carry a mechanism which interacts with the housing such that with relative sliding of the rear portion 22 relative the housing, a screwstrip in the screw feed channel element 76 will be advanced.

The tubular element 44 is open along one side through a longitudinal open slotway 106 extending circumferentially through an angle of about 90° relative the axis 52.

Figure 10:
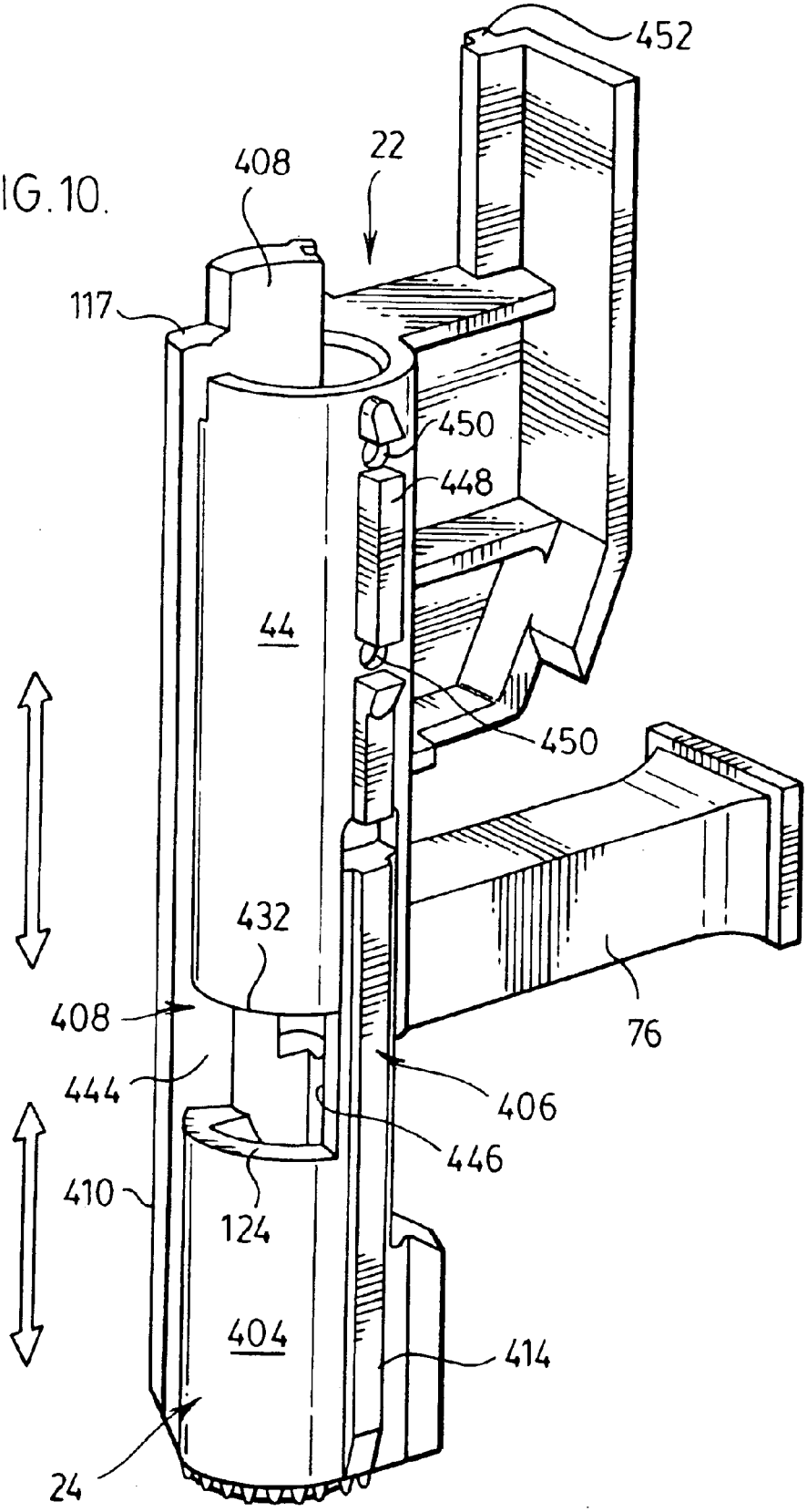
FIG. 10 is a front pictorial view of the slide body of FIG. 7 with the nose portion in a partially retracted toward a rearward position.

As best seen in FIG. 10, the rear portion 22 carries on the outer surface of its tubular element 44 a longitudinally extending rib 448 which is square in cross-section and is adapted to be received within the slot 40 in the side wall 42 of the housing to guide the rear portion 22 in longitudinal sliding within the housing. Two holes 450 are shown for attachment of the slide stop 23 to the rear portion 22 on the outside of the housing.

In addition, the flange 46 of the rear portion 22 carries a longitudinally extending rib 452 of generally square shape which is adapted to be received within a complementary longitudinal slotway in the inside of the rear wall 42 of the housing. This longitudinal rib 452 on the flange 46 is best seen in FIG. 6.

The nose portion 24 of the housing 20 has a generally part-cylindrical screw guide tube 75 arranged generally coaxially about longitudinal axis 52.

The guide tube 75 defines cylindrical bore or guideway 82 extending axially through the guide tube with the guideway 82 delineated and bordered, at least in part, by part-cylindrical inner surfaces of the guide tube 75.

Guide tube 75 has a screw access opening 86 opening on one side effectively throughout the length of the guide tube and a strap exitway 87 opening out of the interior of the guide tube 75 on the other side. Rearward of the exitway 87, there is a rear section 402 of the guide tube 75 and forward of the exitway 87, there is a forward section 404 of the guide tube 75. A front pillar 406 on the front of the nose portion 24 joins the forward section 404 of the guide tube 75 to the rear section 402 of the guide tube. A rear pillar 408 on the rear side of the nose portion joins the front section 404 with the rear section 402. The rear pillar 408 extends rearwardly to a rear end 117 to engage a depth setting cam member 114 as will be described later. The rear pillar 408 carries along its length disposed parallel the axis 52 a longitudinal rib 410 of square shape in cross-section which is adapted to be received in a complementary longitudinal slot 40 in the side wall 43 of the housing to assist in guiding the nose portion in longitudinal sliding in the housing. The rear pillar 408 carries near its end two threaded openings 412 via which the slide stop 25 is secured to the nose portion 24.

The front pillar 406 also carries a longitudinally extending rib 414 of square cross-section which is adapted to be received within the slot 41 in the front side wall 42 of the housing to assist in guiding the nose portion in longitudinal sliding within the housing.

The rear section 402 of the guide tube 75 has a part cylindrical inner surface 416 of a diameter marginally greater than the diameter of a screw to be received therein so as to assist in coaxially locating a screw coaxially with the axis 52. The rear section 402 of the guide tube 75 has a part cylindrical outer surface 418 which is sized to be marginally smaller than a cylindrical inner surface 420 of the tubular element 44 of the rear portion such that the rear section 402 of the guide tube 75 is axially slidably received within the tubular element 44 of the rear portion.

When assembled, the rear pillar 408 is slidably received in the open slotway 106 of the tubular element 44 to close the slotway 106 with the rear section 402 of the guide tube 75 received coaxially within the tubular element 44 longitudinally slidably therein.

Figure 7:
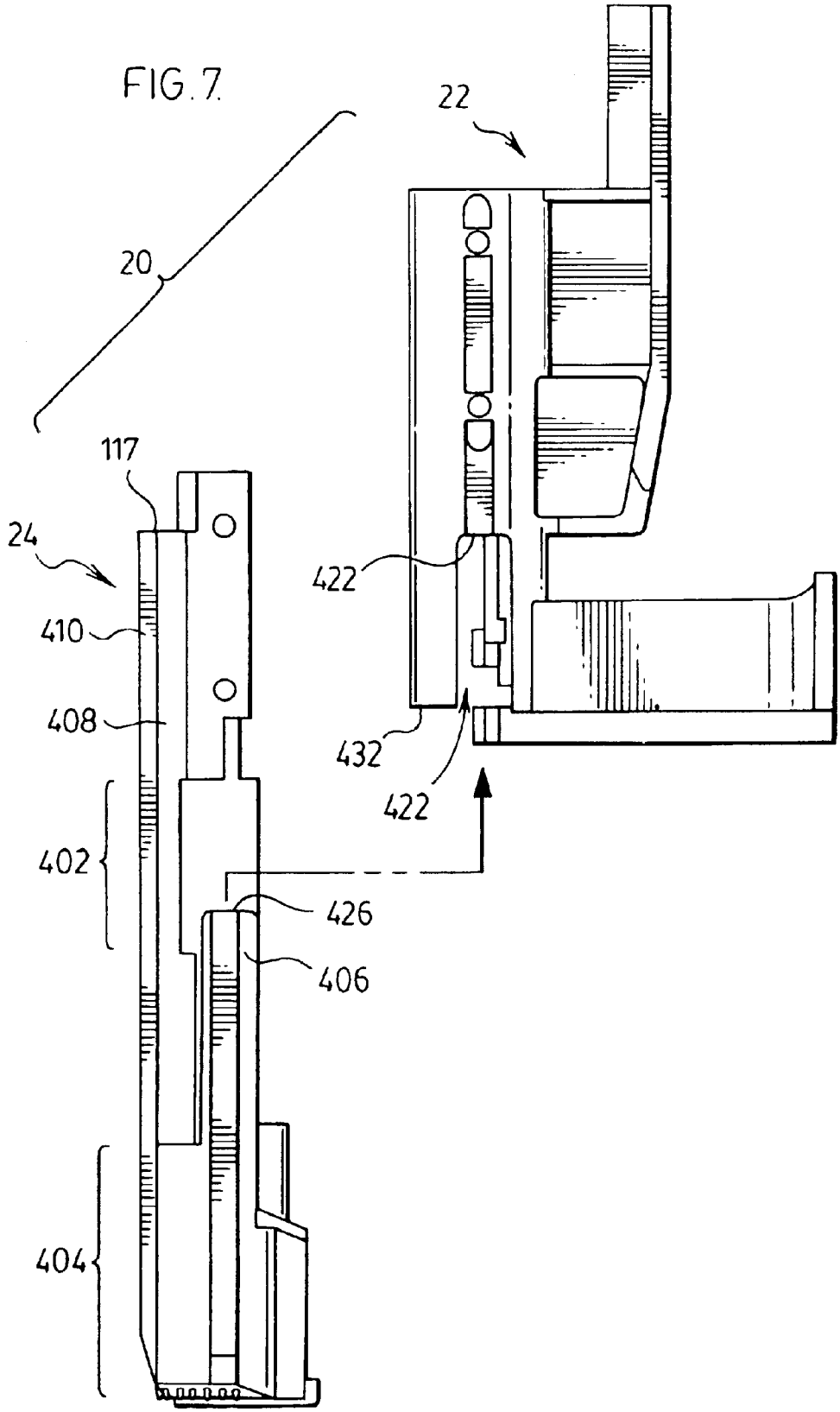
FIG. 7 is a front exploded view of the two components of the slide body as seen in FIG. 6.

As best seen in FIG. 7, the tubular element 44 has a blind slot 422 through its wall open forwardly and closed at a rear end 424. The front pillar 406 is axially slidable into this blind slot 422. The front pillar 406 carries a stop shoulder 426 which engages the blind end 424 of the slot 422 to limited rearward movement of the nose portion 24 relative the rear portion 22 at the rearward position. Receipt of the front pillar 406 in the blind slot 422 also assists in securing the nose portion 24 to the rear portion 22 against relative rotation about axis 52.

Figure 9B:
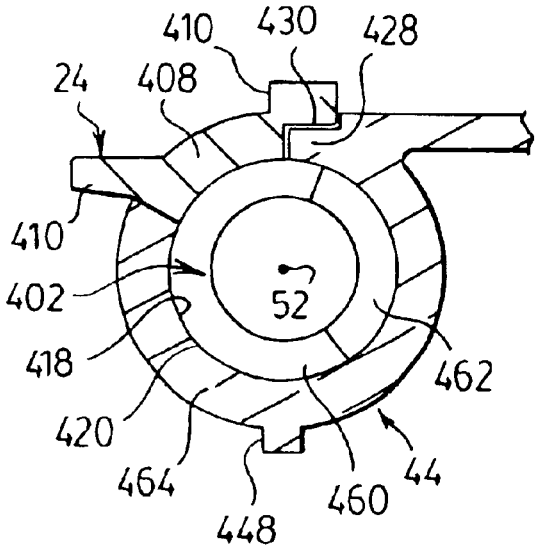
FIGS. 9A and 9B are schematic cross-sectional end views along section lines 9A–9A' and 9B–9B' in FIG. 8.

The edges of the part-cylindrical tubular element 44 adjacent its longitudinal open slotway 106 are provided with outwardly extending ribs 428 to be engaged in a complementary channelway 430 formed in the edge of the rear pillar 408 as best seen in FIG. 9B.

Adjacent the blind slot 422, the tubular element 44 extends forwardly on the side opposite the screw feed channel element 76 so as to present a forwardly directed rear strap locating surface 432.

The forward section 404 of the guide tube 75 has an inner surface which is cylindrical about the axis 52 and of the same radius as the inner surface 416 of the rear section 402 of the guide tube, that is, sized to be marginally greater than the head of the screw to be received therein. Thus, internally within the guide tube 75 from the rear section 402 of the guide tube through the forward section 404 of the guide tube there is provided the guideway 82 within which a screw to be driven is to be located coaxially about the axis 52. The guideway 82 extends forwardly through the nose portion 24 and opens forwardly from the nose portion 24 as forward opening fastener exit opening 136 through which a screw is to be driven.

Screw access opening 86 is provided to permit the screwstrip 14 including retaining strap 13 and screws 16 to move radially inwardly into the guideway 82 from the right as seen in FIGS. 4 and 5. Each screw preferably has a head 17 with a diameter marginally smaller than the diameter of the guideway 82. It follows that where the head of the screw is to enter the guideway 82 over the rear section of the guide tube 402, the screw access opening must have a circumferential extent of at least about 180°. Where the shank of the screw is to enter the guideway as over the forward section 404 of the guide tube 75, the screw access opening may have a lesser circumferential extent.

In the rear section 402 of the guide tube, the inner surface 416 engages the radially outermost periphery of the head 17 of the screw 16, to axially locate the screw head 17 coaxially within the guideway 82 in axial alignment with the drive shaft 34. In this regard, inner surface 416 preferably extends about the screw sufficiently to coaxially locate the screw head and, thus, preferably extends about the screw head at least 120°, more preferably, at least 150° and, most preferably, about 180° or slightly greater than 180°.

An exitway 87, shown towards the left-hand side of the guide tube 75 in FIGS. 4 and 5, is provided of a size to permit the spent plastic strap 13 from which the screws 16 have been driven to exit from the guideway 82. Forwardly of the exitway 87, the inner surface of the forward section 404 of the guide tube 75 is shown as extending greater than 180° about the longitudinal axis 52 so as to continue to positively coaxially guiding the head 17 of a screw 16 being driven.

A forwardmost contact surface 130 is disposed about the fastener exit opening 136 adapted to engage the outer surface 132 of a workpiece 134. The fastener exit opening 136 is provided on a touch down flange 434 on the nose portion 24 which flange 434 extends transversely to the axis 52 adjacent to the exit opening 136. The flange 434 has a rearwardly directed surface 436 which carries a conical recess 438 which is adapted to engage the tip of a next screw to be driven and in certain circumstances to sandwich the next screw axially between the flange 434 and the screw feed channel member 76 of the rear portion 22 and thus prevent further rearward movement of the nose portion 24 relative the rear portion 22. Adjacent the rear pillar 408, the forward section 404 of the guide tube 75 carries a rear stop shoulder 440 which is adapted to engage a forwardly directed surface 442 of the wall 91 on the screw feed channel element 76 to stop rearward movement of the nose portion relative the rear portion in the rear position.

Figure 8:
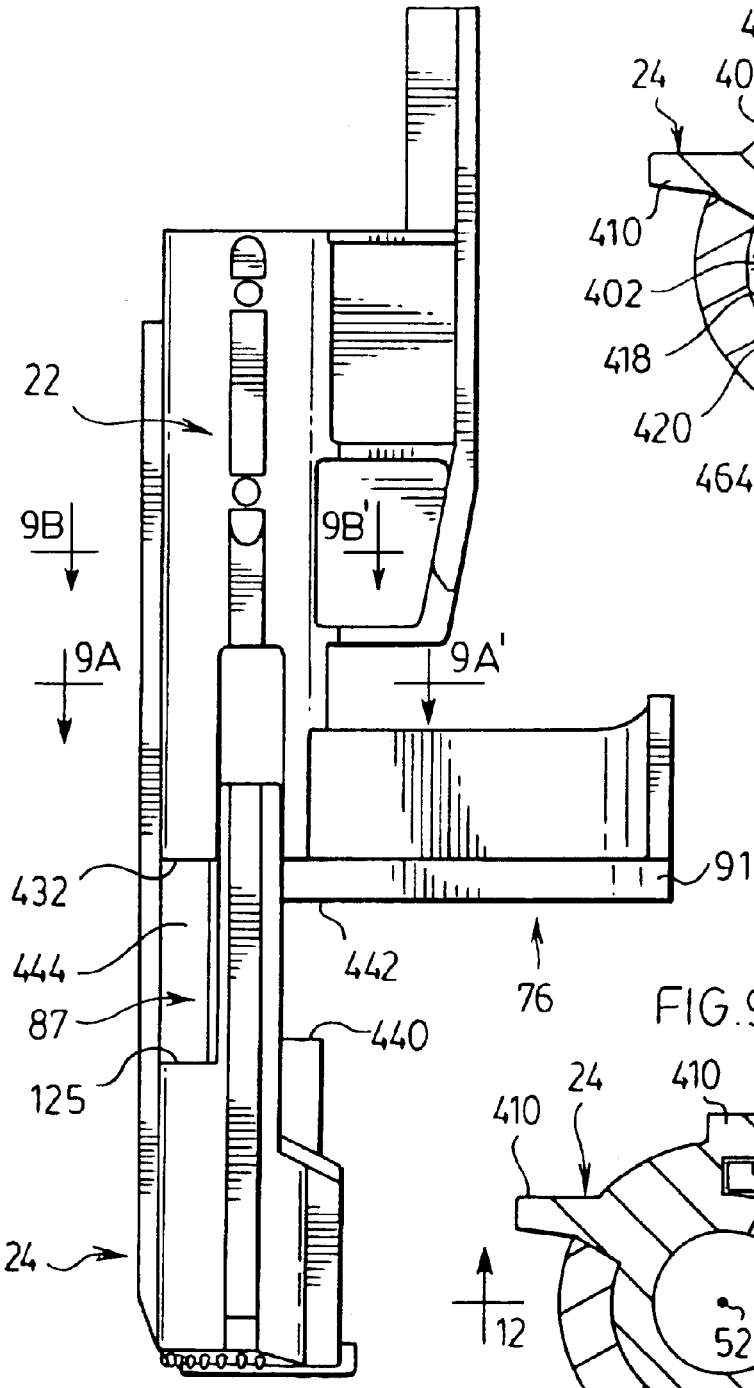
FIG. 8 is a front view of the slide body as seen in FIG. 7 but with the nose portion and rear portion assembled in a forward position.
Figure 11:
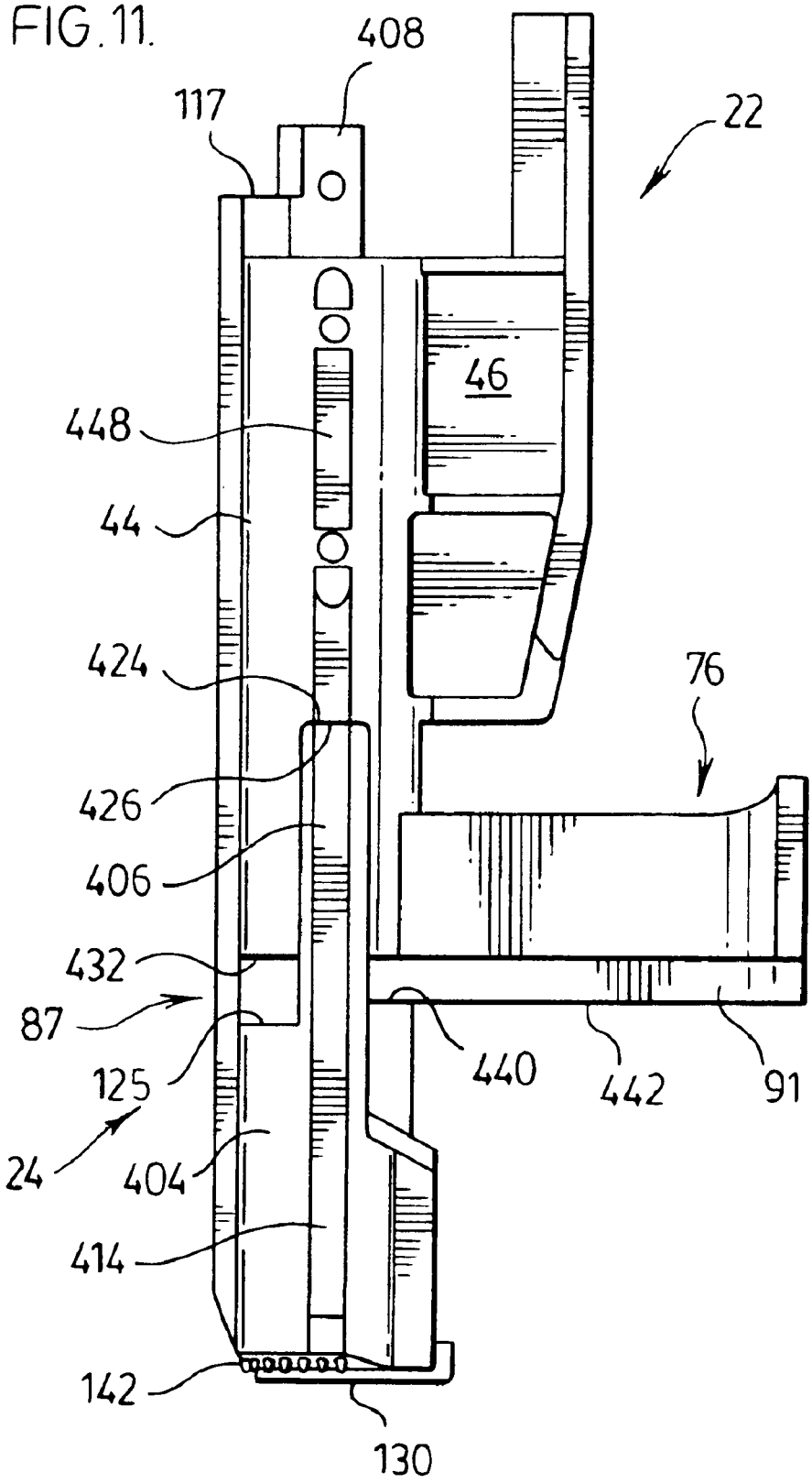
FIG. 11 is a front view of the slide body similar to that as seen in FIG. 8 but with the nose portion in rearward position.

The rear portion 22 and nose portion 24 are coupled together for displacement parallel to the axis 52 of the drive shaft between a forward position and a rearward position. The forward position is illustrated in FIG. 8 and represents a position in which the nose portion 24 is moved forwardly to a maximum extent relative to the rear portion 22. The rearward position is illustrated in FIG. 11 and illustrates a position in which the nose portion is moved rearwardly to a maximum extent relative to the rear portion. FIG. 10 is a pictorial view illustrating the rear portion and nose portion as coupled together for relative longitudinal sliding and showing a position intermediate the forward portion and the rearward portion.

Figure 12:
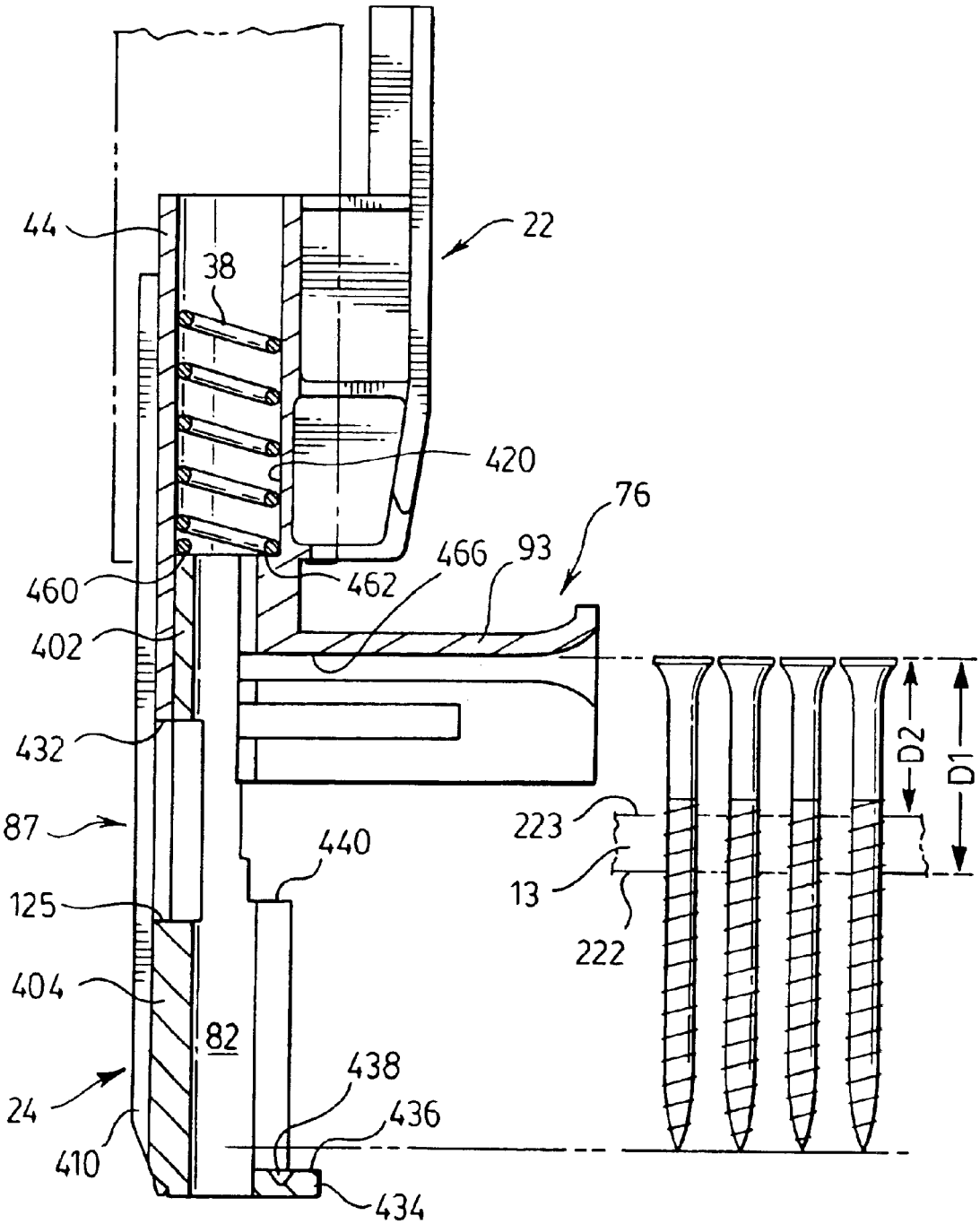
FIG. 12 is a front cross-sectional view along line 12–12' in FIG. 9 of the slide body of FIG. 8 with the nose portion in a forward position with a screwstrip having 3½ inch screws.
Figure 13:
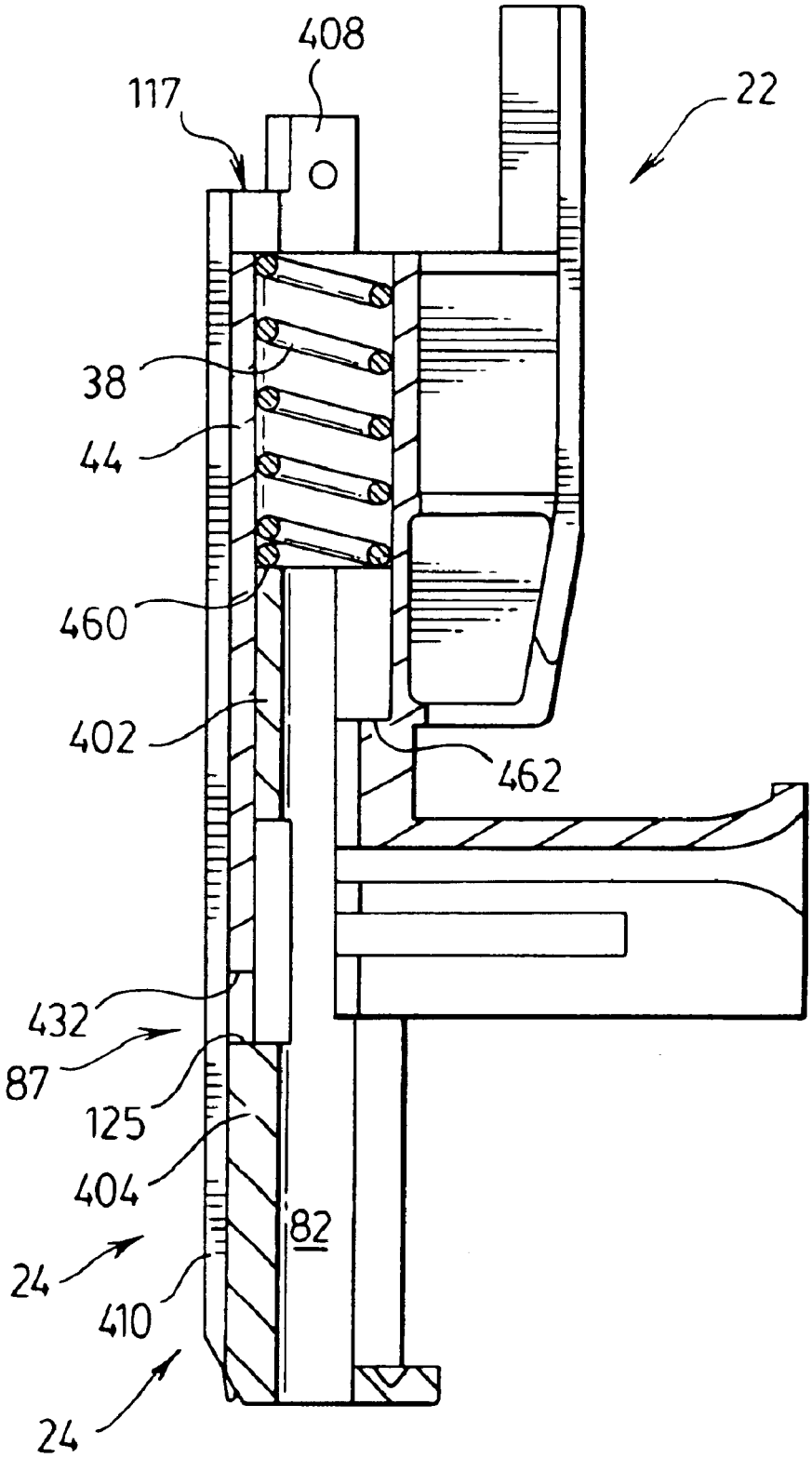
FIG. 13 is a front cross-sectional view of the slide body, the same as in FIG. 12 but with the nose portion in a rearward position.

FIG. 12 illustrates a cross-sectional view through FIG. 8 showing the forward position. FIG. 13 illustrates a cross-section view through FIG. 11 showing the rearward.

In the rearward position of FIG. 11 it is to be seen that rearward movement of the nose portion 24 relative the rear portion is stopped at the rearward position by the stop shoulder 426 on the front pillar 406 engaging the rear end 424 of the blind slot 422 on the rear portion and the stop shoulder 440 on the forward section of the guide tube 75 engaging the forwardly directed surface 442 of the wall 91 of the screw feed channel element 76.

In the forward position as seen in FIGS. 8 and 12, the exitway 87 has a rearwardly directed front strap locating surface 125 carried by the nose portion 24 and, as well, a forward side surface 444 and rear side surface 446 defined by the inside surfaces of the front pillar 406 and rear pillar 408. A rear perimeter of the exitway 87 is defined by the forwardly directed rear strap support surface 432 of the tubular element 44 of the rear portion 22. With rearward movement of the nose portion 24 relative the rear portion 22, the axial extent of the exitway 87 is reduced with the front strip locating surface 125 moved rearwardly closer to the rear strap locating surface 432 of the tubular element 44.

The slide body comprising the rear portion 22 and the forward portion 24 are coupled together and are slidably received within the housing 18. A compression spring 38 is disposed between the housing 18 and the slide body 20 coaxially about the driver shaft 34. The socket 27 of the housing 18 ends at its forward end as a plate 456 with a central opening therethrough, through which the drive shaft extends. An elongated tube 458 is formed as an integral part of this plate extending forwardly from the plate. A rear end of the spring 38 engages the forward surface of the plate 456 with the tube extending coaxially within the spring 38 to assist in preventing the spring from engaging the driver shaft. The front end of the spring 38 is received within the tubular element 44. The spring 38 is of a diameter smaller than the inside diameter of the inner surface 420 of the tubular element 44. As best seen in FIGS. 12 and 13, the forward end of the spring, at all times, engages a rearwardly directed surface 460 on the rear section 402 of the guide tube 75 so as to bias the nose portion 24 forwardly relative to the housing 18.

The rear portion 22 carries at a forward location in the tubular element 44 a rearwardly directed spring stop shoulder 462 which extends radially inwardly further than the inner surface 420 of the tubular element 44 over a small angular sector of the tubular element 44. As best seen in FIG. 9B, the tubular element 44 has a wall 464 which extends about 270° about the axis and defines inner surface 420 inwardly thereof. The spring stop shoulder 462 comprises part of the tubular element 44 and is fixed to the wall 464 extending radially inwardly thereof. The guide tube 75, as seen in FIG. 9B, includes the rear pillar 408 and the rear section 402 carrying the surface 460 to be engaged by the spring. The rear section 402 has its outer surface 418 for sliding inside the inner surface 420 of the tubular element 44. The rear section 402 extends about 240° about the axis 52 and the spring stop shoulder 462 is a rear end of a part-cylindrical tube complementary to the rear section 402 but fixed to the tubular element 44. This spring stop shoulder 462 is adapted to be engaged by the forward end of the spring 38 so as to urge the rear portion 22 to a forward extended position relative to the housing 18.

Referring to FIG. 13, showing the rear position with the nose portion 24 retracted rearwardly relative to the rear portion 22, the front end of the spring 38 merely engages the rear surface 460 on the rear section 402 of the guide tube 75 biasing the nose portion forwardly. The front end of the spring has been moved by the rear section 402 of the guide tube 75 rearward from engagement with the spring stop shoulder 462 on the rear portion 22.

In contrast, in the forward position as shown in FIG. 12, the front end of the spring 38 has biased the nose portion forwardly to the forward portion relative to the rear portion and, in this position, the spring 38 engages both the spring stop shoulder 462 on the rear portion and the rear surface 460 on the nose portion such that the spring 38 acts to bias the entire slide body forwardly.

Figure 14:
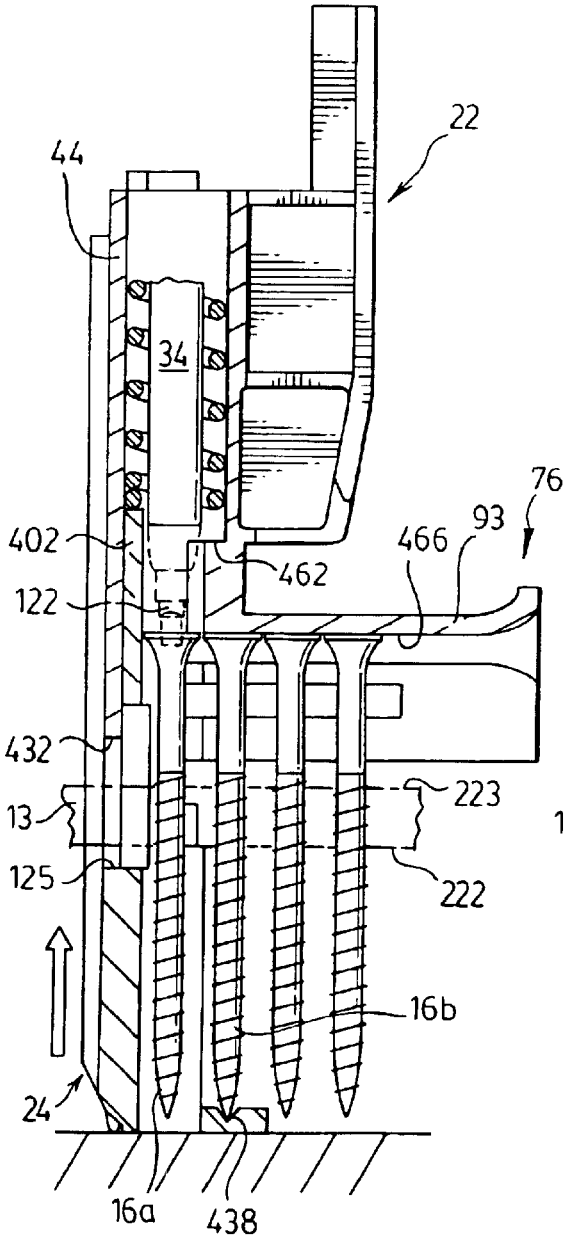
FIG. 14 is a front cross-sectional view of the slide body as in FIG. 12 but with the nose portion retracted to engage the next screw and without the rear body being retracted relative the housing.
Figure 15:
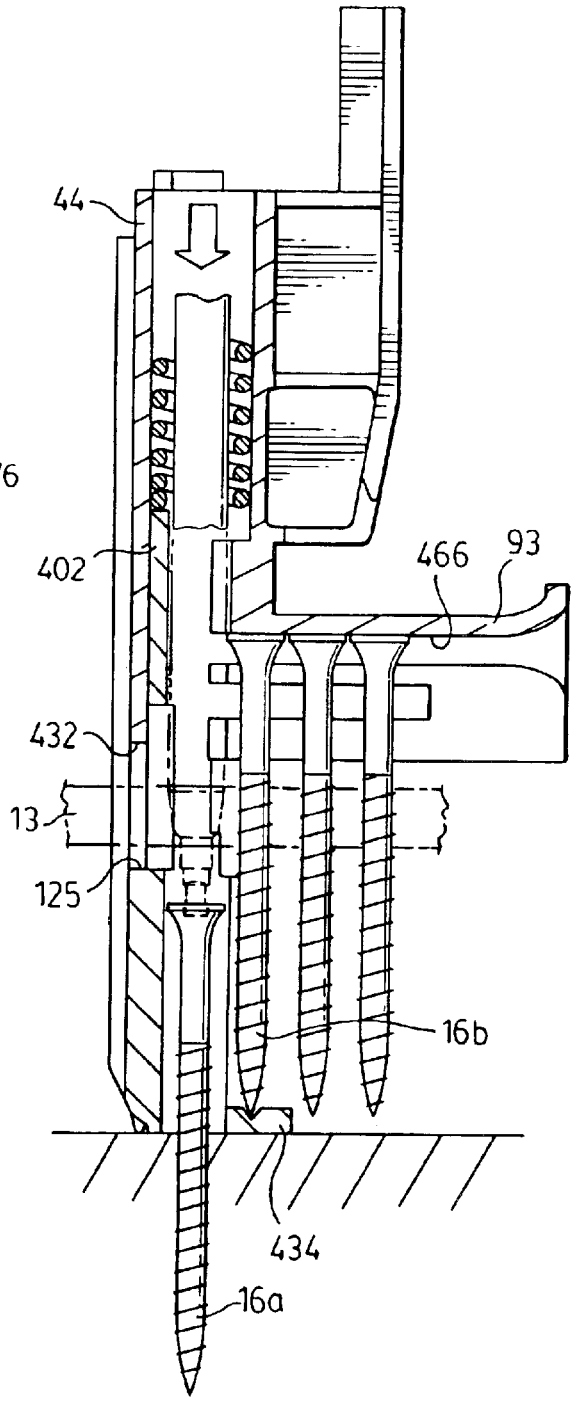
FIG. 15 is a front cross-sectional view as in FIG. 14 but with both the portion and body retracted relative the housing.

Operation of the tool is now described with reference to FIGS. 12, 14 and 15 in the context of driving screws from a screw strip. In FIGS. 12, 14 and 15, the screw strip is illustrated as having screws of a 3½ inch length which are held in a plastic strap 13 as are commercially available with the strap 13 having a forward surface 222 at a distance D1 from the tops of heads of the screw and a rear surface 223 at a distance D2 from the tops of the heads of the screw.

Commercially available screwstrips carrying screws of 3½ inch length are sold under the trade mark QUIK DRIVE, have the forward surface 222 located at a distance D1 equal to 1¼ inches from the head of the screw, the strap having a height measured axially the screws of about 5/16 of an inch and the rear surface 223 of the strap located a distance of D2 of about 15/16 from the top of the head of a screw.

FIG. 12 shows the nose portion 24 in a forward position relative the rear portion 22. The nose portion and rear portion are configured as adapted to drive screws of a maximum length of about 3½ inches as are shown in FIG. 12. As seen in FIG. 12, the axially distance between the forwardly directed surface 466 of the wall 93 of the screw feed channel element 76 and the rearwardly directed surface 436 of the flange 434 on the nose portion 24 is greater than the length of the screws. This permits the screws to be advanced in known manner radially relative the axis 52 into the guide way 82 to be disposed coaxially with the driver shaft.

FIG. 14 illustrates a position in which a screw to be driven, indicated as 16*a*, is coaxially disposed within the guide way 82 with spent strap 13 from which screws have been driven extending out the exitway. The nose portion has been engaged with the work piece and the nose portion has been moved rearwardly relative to the rear portion to an extent that the tip of the next screw to be driven, indicated 16*b*, is engaged in the recess 438 in the flange 434. The next screw 16*b* has become sandwiched between the forwardly directing surface 466 of the wall 93 of the screw feed element channel 96 and the flange 434 on the nose portion 24 thus preventing further rearward movement of the nose portion 24 relative the nose portion 22 and in which relative fixed position the nose portion 24 and rear portion 22 will slide rearwardly relative to the housing 18 on further manual urging of the tool into the workpiece. FIG. 14 illustrates a condition in which the slide body 20 comprising the nose portion 24 and rear portion 22 fixed in the condition shown is slid rearwardly relative the housing 18 and the bit has just engaged the screw 16*a* to be driven.

FIG. 15 illustrates a subsequent condition that the driver of FIG. 14 comes to assume after the slide body 20 has retracted further into the housing 18 towards the retracted position. As can be seen, the driver shaft and its bit have engaged the screw 16*a* to be driven and have driven it forwardly into the workpiece severing the screw 16*a* from engagement with the strap 13. As seen in comparing FIGS. 14 and 15, the relative position of the screws and strap 13 other than the screw 16*a* being driven and the relative position of the nose portion 24 relative to the rear portion 22 has not changed, however, the spring 38 is shown to have been increasingly compressed as would be the case since the entire slide body 20 has been moved rearwardly relative to the housing 18, not shown.

In FIGS. 12, 14 and 15, it is seen that the spent strap 13 extends out the exitway 87 and is not engaged by the rear strap locating surface 432 or the front strap locating surface 125 of the exitway.

Figure 16:
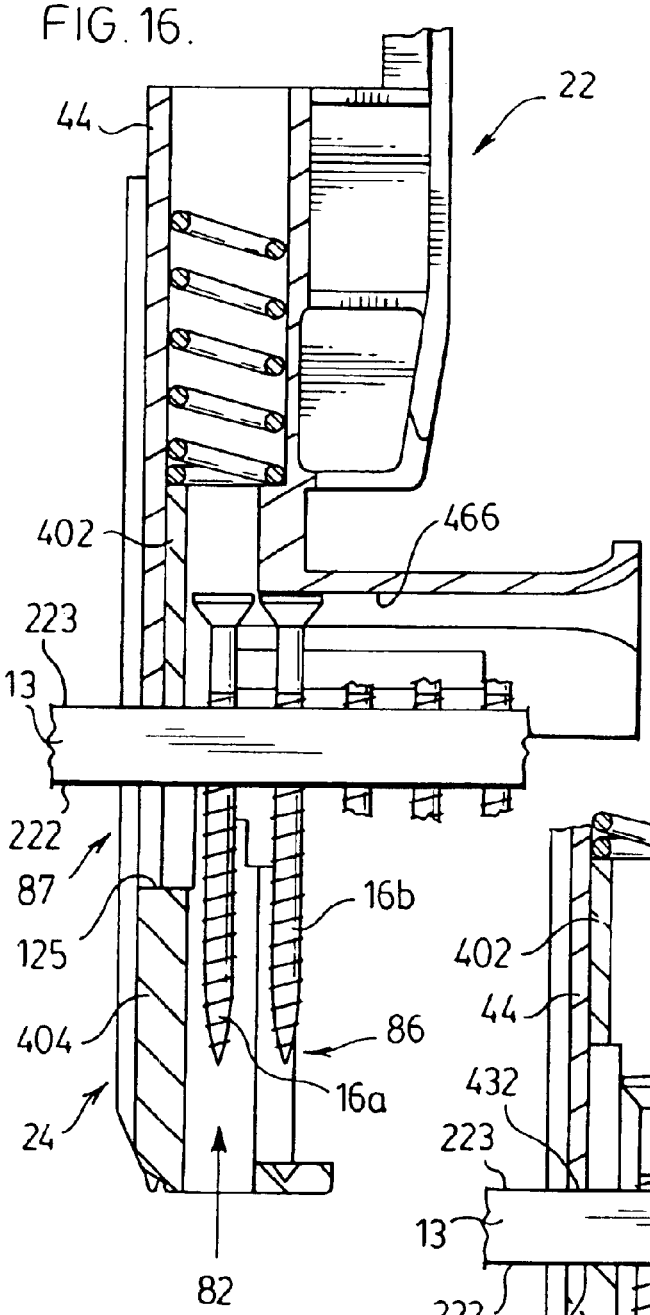
FIG. 16 is a front cross-sectional view of the slide body in a position as in FIG. 14 but with 2½ inch screws.
Figure 17:
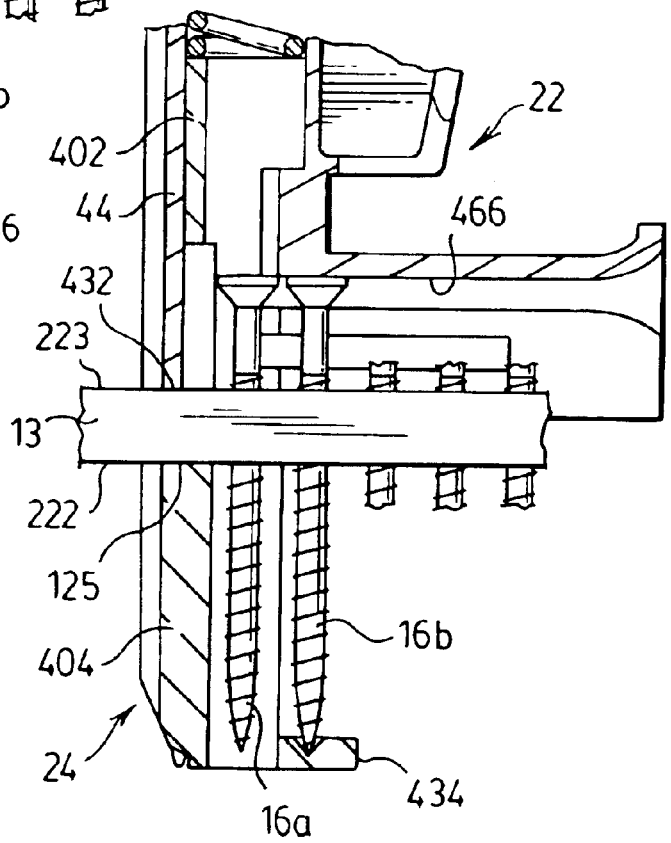
FIG. 17 is a front cross-sectional view similar to that in FIG. 16 with the nose portion in a rearward position as in FIG. 11.

Reference is made to FIGS. 16 and 17 which illustrate the identical nose portion and rear portion to that shown in FIGS. 12 and 14. However, FIGS. 16 and 17 illustrate driving a screwstrip with screws of 2½ inch length.

The 2½ inch screws as illustrated in FIGS. 16 and 17 are commercially available screws sold under the trade mark QUIK DRIVE and in which the distance D1 of the forward surface 222 from the top of the head is 5/16 inch, the height of the strap 13 as measured parallel the axis of the screws is 5/16 inch and the distance D2 of the rear surface 223 is from the top of the screws is 9/16 inch. Commercially available screws sold under the trade mark QUIK DRIVE which are of lengths between 3 inches and 1¼ inches have a similar configuration with D1 being 5/16 inch, the height of the strap being 5/16 inch and D2 being 9/16 inch. The screws illustrated in all the Figures, including FIGS. 12 and 14 to 19, all have the same head diameter, being a head diameter complementary to that of the diameter of the guideway 82.

FIG. 16 illustrates a condition in which, with the nose portion 24 in the forward position, the screwstrip has been advanced with a screw 16*a* to be driven coaxially in the guideway 82 and the next screw 16*b* adjacent to it. FIG. 17 illustrates a condition in which, on urging the tool into a workpiece, the nose portion has moved rearwardly towards the rear position relative to the rear portion 22 such that two conditions arise. Firstly, the next screw 16*b* has been sandwiched between the flange 434 of the nose portion and the screw feed channel element 76 of the rear portion. Secondly, the rearward facing forward strap locating surface 125 has engaged the forward surface 222 of the strap 13 and the forwardly facing rear strap locating surface 432 of the tubular element 44 of the rear portion has engaged the rear surface 223 of the strap 13. FIG. 17 illustrates a condition in which the nose portion 24 and rear portion 22 are approximately in the rear position.

Referring now to FIGS. 18 and 19, FIGS. 18 and 19 show the use of the identical nose portion and rear portion to that shown in FIGS. 16 and 17 but in conjunction with a screwstrip having screws of a length of 1½ inches and relative distances D1 and D2 the same as that with a 2½ inch screw illustrated in FIGS. 16 and 17. FIG. 18 illustrates the nose portion 24 and rear portion 22 in the forward position. FIG. 19 illustrates the nose portion 24 and rear portion 22 in a position which is substantially the rear position and in which the spent strap 13 is engaged, with the forward surface 222 of the strap 13 engaged by the rearwardly directed forward locating surface 125 of the nose portion and the rear surface 223 of the strap 13 engaged by the forwardly directed rear locating surface 432 of the rear portion.

The nose portion and rear portion illustrated have been particularly adapted such that when screws of 2½ inch length are shown as illustrated in FIGS. 16 and 17, such screws are held both by the next screw 16*b* being sandwiched between the touchdown flange 434 on the nose portion and the rear portion and, as well, with the spent strap 13 being engaged by the forward strap support surface 125 of the nose and the rear locating surface 432 of the rear portion. For all screws which are shorter than 2½ inch length and which have a strap 13 at a preset location and of a preset axial extent, then such screws will, as illustrated in FIGS. 18 and 19, be adapted to be held merely by engagement of the strap 13 in the exit opening 87 between the forward locating surface 125 on the nose portion and the rear locating surface 432 on the rear portion.

The slide body as illustrated in FIGS. 12 to 19 is adapted for driving screws of substantially different lengths, for example, from 3½ inch lengths to 1½ inch lengths and shorter without the need for any adjustment or modification of the driving tool. For example, after use in driving a 3½ inch screw from a screwstrip, that screwstrip may be withdrawn from the tool and another screwstrip having screws of, say, 1½ inch, may then be inserted into the tool and directed driven by the tool without the need for any adjustment of the tool whatsoever other than replacement of one screwstrip by another screw strip.

In the preferred embodiments as, for example, as illustrated in FIG. 19, the spent strap 13 is shown as being engaged both on its forward surface 222 by the forward locating surface 125 and on its rear surface 223 by the rear locating surface 432. This is preferred but not necessary. The tool will function merely by engagement of the forward surface 222 of the strap 13 by the front locating surface 125 without need for the rear surface 223 to be engaged by the rear locating surface 432 of the rear portion. It is preferred, however, if both the forward surface 222 and the rear surface 223 are engaged. Most preferably, it is advantageous that the spent strap 13 is pinched between the forward locating surface 125 and the rear locating surface 432. The strap 13 is preferably pinched and, to some extent, compressed between the forward locating surface 125 and the rear locating surface 432 when the nose portion 22 is proximate the rearward position relative to the rear portion. For example, it is within the skill of a person skilled in this art to provide for engagement of the strap 13 between the forward locating surface 125 and the rear locating surface 434 a small distance forward of the rearward position of the nose portion on the rear portion. Subsequently, to the extent that the strap 13 is being pinched and may be compressed axially, the extent of axial compression may be limited by the nose portion assuming the rearward portion relative to the rear portion.

Insofar as the rearward surface 223 of the strap 13 is to be engaged by the forward locating surface 432 on the rear portion, the rear surface 223 of the strap on the rear portion should advantageously be located a constant distance forward from the heads of the screw, preferably, the top surface of the screw. As well, it is further preferred in accordance with the present invention that the strap 13 has a constant height as measured parallel to the axis of the screws such that both the rearward surface 223 and the forward surface 222 are located at constant fixed distances of the head of the screw. The present invention provides in combination an autofeed screwdriver attachment for collated screws as described together with collated screws having at least with one of the forward surface 222 and the rear surface 223 at a constant distance from the head of the screw and preferably both at constant distances.

As seen in the Figures, the rear surface 223 of the strap is engaged by the forward locating surface 432. Rather than have the entire rear surface 223 of the strap 13 be located at a constant distance from the heads, it is possible to merely have the portions of the strap between the screws which is to be engaged by the rear locating surface 432 to be at a constant distance from the heads. Similarly, the entirety of the forward surface 222 may be a constant distance from the heads or merely the portion to be engaged by the forward locating surface 125.

With the preferred embodiment of the nose portion and rear portion, screws of a length less than 2½ inches are driven without the flange 434 functioning to hold the screws to be driven. The present invention includes embodiments in which the nose portion is provided without the flange 434 and no provision is made to hold the screwstrip by sandwiching the next screw between the nose portion and the rear portion. With the flange 434 removed, a screwstrip could be held in a similar manner as that described above in FIGS. 18 and 19 without the next screw being sandwiched and with the strap 13 pinched by or engaged between both the rear locating surface 432.

The preferred embodiment has been described with reference to a preferred shuttle arrangement for advancing successive screws in a screwstrip. It is to be appreciated that a split slide body of this application including its separate nose portion and rear portion may be adapted for use in many other types of fastener driving tools in which the screws or screwstrips are advanced by different mechanisms and different mechanisms are provided juxtaposition between the slide body and housing to activate the advance of the screwstrip.

The preferred embodiments utilize a single spring 38 to both bias the slide body 20 forwardly and to bias the nose portion 24 forwardly relative to the rear portion. Rather than provide a single spring, two springs could be provided, one operative to act between the housing 18 and the rear portion 22 and the second operative to act between the rear portion 22 and the front portion 24. The spring to act between the nose portion and the rear portion would compress under less forces than that required to compress the spring between the rear portion 22 and the housing 18 such that the nose portion 25 would retract relative the rear portion before the rear portion retracted relative to the housing.

Figure 2:
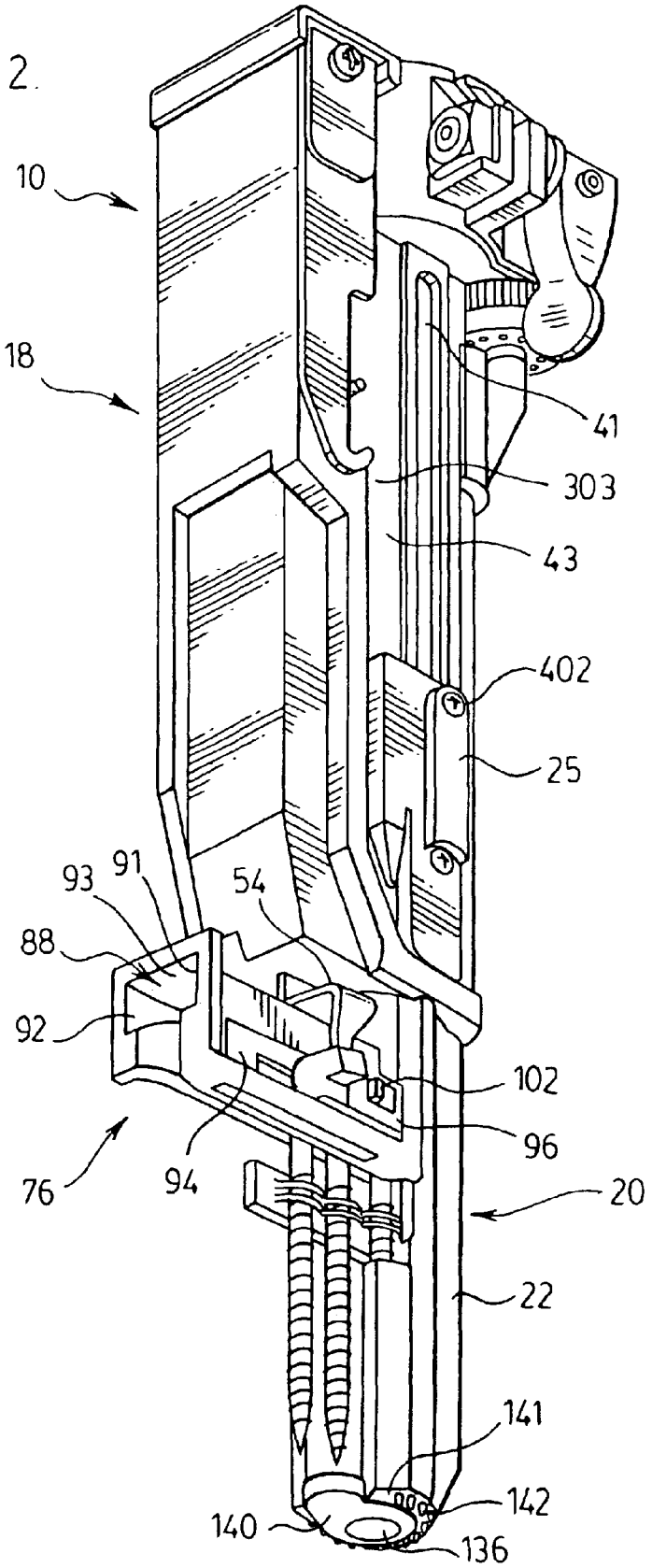
FIG. 2 is a rear view of the driver attachment in FIG. 1.

The screw feed channel element 76 carried on the rear element 22 is best seen in FIGS. 2, 3 and 4 as providing a channelway 88 which extends radially relative the longitudinal axis 52 to intersect with the guideway 82 in the guide tube 75. In this regard, the channelway 88 opens to the guideway 82 through the screw access opening 86. The channelway 88 provides a channel of a cross-section similar to that of the screw access opening 86 from the screw access opening 86 to a remote entranceway opening 90. The channelway 88 is defined between two side walls 91 and 92 joined by a top wall 93. The major side wall 91 is shown as extending from the heads 17 of the screws 16 forwardly to at least partially behind the plastic retaining strap 13. The lesser side wall 92 is shown as extending from the heads 17 of the screws 16 forwardly to above the plastic strap 13. As seen in FIGS. 18 and 19, the forward surface 454 of the lesser side wall 92 is immediately above the rear surface 223 of the strap 13 and assists in locating the strap. In the preferred embodiment, the rear strap locating surface 432 is disposed at the same axial location as the forward surface 454 of the lesser side wall 92. Stopping the lesser side wall from extending down over the strap 13 assists in reducing friction between the strap 13 and the lesser side wall. The side walls 91 and 92 define the channelway 88 with a cross-section conforming closely to that of the screwstrip 14 and its strap 13 and screws 16 with an enlarged width where the heads of the screws are located and an enlarged width where the retaining strap 13 is provided about the screws. The side walls 91 and 92 also have an enlarged funnelling section at the entranceway opening 90 which tapers inwardly to assist in guiding the screwstrip to enter the channelway.

Cam Activated Advance of Shuttle

A lever 48 is pivotally mounted to the flange element 46 of the rear portion 22 by axle 50 for pivoting about an axis of axle 50 normal to the longitudinal axis 52 which passes centrally through the drive shaft 34 and about which the drive shaft is rotatable. Lever 48 has a forward arm 54 extending forwardly to its front end 56 and a rear arm 58 extending rearwardly to its rear end 60.

The rear arm 58 of the lever 48 carries a cam pin 502 near its rear end 60. The cam pin 502 is a removable cylindrical pin threadably received in threaded opening 503 in rear arm 58. A cam slot 506 is provided in the side wall 302 of the housing 18.

The cam slot 506 has a first camming surface 508 and a second camming surface 510 spaced therefrom and presenting different profiles as best seen in side view in FIG. 3. The cam pin 502 is received in cam slot 506 between the first and second camming surfaces 508 and 510 for engagement of each under different conditions of operation. Spring 69 about axle 50, as shown in FIG. 5, biases the lever 48 in a clockwise direction as seen in FIG. 5 and thus biases the lever to pivot in a direction which moves a shuttle 96 shown in FIG. 2 towards the axis 52 of the guide tube and biases the cam pin 502 towards the first camming surface 508.

In operation of the driver attachment, the slide body 20 moves relative the housing 18 in a cycle of operation in which the rear portion 22 of the slide body moves relative the housing in a retracting stroke from the extended position to the retracted position and then moves in an extending stroke from the retracted position to the extended position. Whether in any position in a cycle the cam pin 502 will engage either the first camming surface 508 or the second camming surface 510 will depend on a number of factors. Most significant of these factors involve the resistance to movement of the shuttle 96 in either direction as compared to the strength of the spring 69 tending to move the shuttle 96 towards axis 52. Under conditions in which the bias of the spring 69 is dominant over resistance to movement of the shuttle 96, then the bias of the spring will place the cam pin 502 into engagement with the first camming surface 508 with relative motion of the lever 48 and therefore the shuttle 96 relative the position of the slide body 20 in the housing 18 to be dictated by the profile of the first camming surface 508. Under conditions where the resistance to movement of the shuttle is greater than the force of the spring 96, then the cam pin 502 will either engage the first camming surface 508 or the second camming surface 510 depending on the direction of such resistance and whether the slide body is in the retracting stroke or the extending stroke. For example, in an extending stroke when the shuttle 96 is engaging and advancing the next screw to be driven and the resistance offered to advance by the screwstrip may be greater than the force of the spring 69, then the cam pin 502 will engage on the second camming surface 510.

In the preferred embodiment shown, as best seen in FIG. 3, the first camming surface 508 has a first portion 514, a second portion 516 and a third portion 518. The first portion 514 and the second portion 518 are substantially parallel the driver shaft axis 52. Second portion 516 extends at an angle rearwardly and towards axis 52.

The second camming surface 510 has a first portion 520 which extends angling forwardly and away from axis 52 and a second portion 522 which is substantially parallel the axis 52.

The third portion 518 of the first camming surface 508 and the second portion 522 of the second camming surface 510 are parallel and disposed a distance apart only marginally greater than the diameter of cam pin 502 so as to locate the cam pin 506 therein in substantially the same position whether the cam pin 502 rides on first camming surface 508 or second camming surface 510.

The cam slot 506 has a front end 512 where the first portion 514 of the first camming surface 508 merges with the first portion 520 of the second camming surface 510. In the front end 512, the width of the cam slot 506 is also only marginally greater than the diameter of the cam pin 502 so as to locate the cam pin 506 therein in substantially the same position whether the cam pin 502 rides on the first camming surface 508 or the second camming surface 510.

The first portion 520 of the second camming surface 510 is spaced from the first camming surface 508 and, in particular, its first portion 514 and second portion 516 by a distance substantially greater than the diameter of cam pin 502.

A more detailed description of the interaction of the cam pin 502 in the cam slot 508 is found in U.S. Pat. No. 5,934,162 to Habermehl.

Pawl Mechanism

As best seen in FIG. 2, the major side wall 91 is provided on its exterior back surface with a raceway 94 extending parallel the channelway 88 and in which a shuttle 96 is captured to be slidable towards and away from the guide tube 75 between an advanced position near the guide tube and a withdrawn position remote from the guide tube. The shuttle 96 has a rear surface in which there is provided a rearwardly directed opening 98 adapted to receive the front end 56 of the forward arm 54 of lever 48 so as to couple the shuttle 96 to the lever 48 for movement therewith.

Figure 9A:
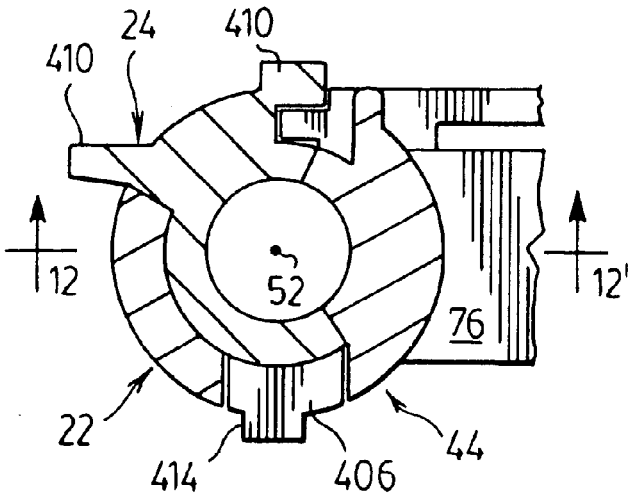
Figure 23:
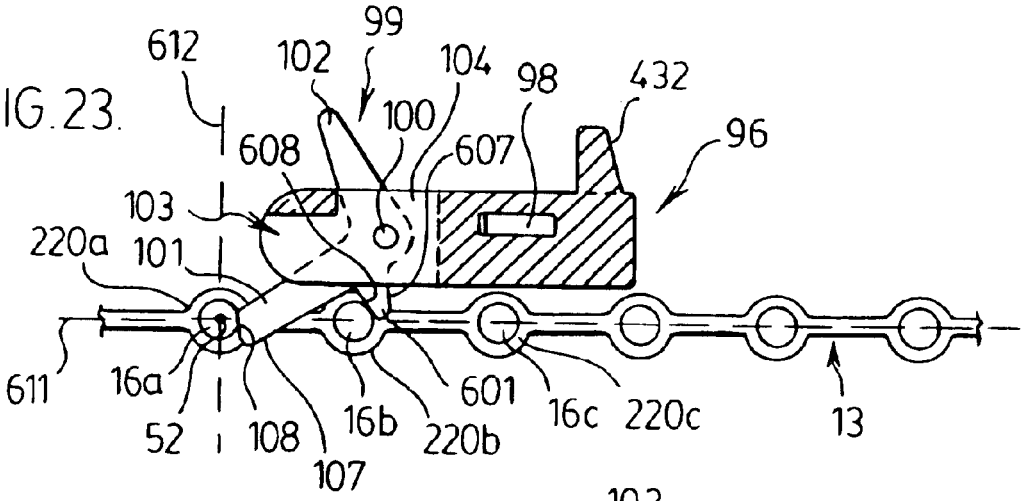
FIG. 23 is a schematic cross-sectional view along line 23–23' in FIG. 4 merely showing the screwstrip and shuttle in a fully advanced position.
Figure 25:
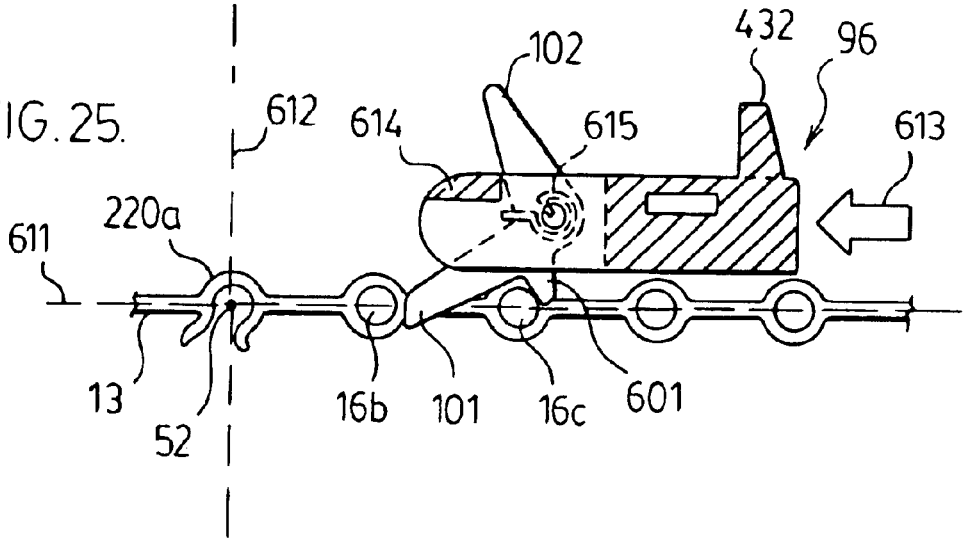

Shuttle 96 carries a pawl 99 to engage the screwstrip 14 and with movement of the shuttle 96 to successively advance the strip one screw at a time. As seen in FIG. 23, the shuttle 96 has a fixed post 100 on which the pawl 99 is journalled about an axis parallel the longitudinal axis 52 about which the driver shaft rotates. The pawl 99 has a first pusher arm 101 at its forward end to engage a first lead screw **16*a* and a second pusher arm 601 to engage a second screw 16*b*. The pusher arms extend out from slot 103 in the shuttle 96 and through a slot 105 in the major side wall 91 of the feed channel element 76 to engage and advance the screwstrip. The pawl 99 has a manual release arm 102 which extends out away from the screwstrip through the opening 104 from slot 103 of the shuttle 99. A torsional spring 615, shown only in FIG. 25, is disposed about post 100 between pawl 99 and shuttle 96 and urges the first pusher arm 101 counterclockwise as seen in FIG. 23. The torsional spring biases the pusher arms into the screwstrip 14. The engagement of release arm 102 on the left-hand end of opening 104 limits the pivoting of the pawl 99 counterclockwise to the blocking position shown in FIG. 9**.

The first pusher arm 101 has a cam face 107 and the second pusher arm 601 has a cam face 607. On the shuttle moving away from the guide tube 75 towards the withdrawn position, i.e., to the right from the position in FIG. 23, the cam faces 107 and/or 607 will engage the screws **16*b* and 16*c*, respectively, and/or the strap 13 and permit the pawl 99 to pivot about post 100 against the bias of the torsional spring to a passage position so that the shuttle 96 may move to the right relative the screwstrip 14**.

The first pusher arm 101 has an engagement face 108 to engage the screws 16 and the second pusher arm 601 has an engagement face 608 to also engage the screws 16. On the shuttle moving towards the guide tube 75, that is, towards the advanced position and towards the left as seen in FIG. 25, the engagement faces 108 and 608 will engage the screw **16*b* and 16*c*, respectively, and/or strap 13 and advance the screwstrip to the right as seen in FIG. 25 so as to position a screw 16*b* into the guideway 82 in a position to be driven and to hold the screwstrip 14 against movement towards the left. Preferably, as shown in FIG. 4, the engagement face 108 of the first pusher arm 101 engages the screw 16 between its head 17 and the strap 13 as this has been found advantageous, particularly to avoid misfeeding with a nose portion 24 as shown with engagement of the screw heads in the channelway 88 and engagement of the spent strap 13 with the support surface 125**.

The operation of the shuttle 96 and pawl 99 in normal operation to advance the screwstrip are illustrated in FIGS.

23, 24 and 25, representing successive steps in a cycle of reciprocating the shuttle 96 back and forth in the raceway 94.

As seen in FIG. 25, a dashed line 611 represents a plane of advance in which the axis of each of the screws 16 lie and along which the screwstrip 14 is advanced towards the left such that screws may successively be brought into alignment with the driver shaft whose axis 52 is to occur at the intersection of advance plane 611 with a dashed axis line 612. To the left of axis line 612, spent strap 13 is shown with a broken sleeve 220*a* from which a screw has been driven.

As seen in FIG. 23, the engagement face 108 of the first pusher arm 101 is engaged behind the first screw 16*a* and the engagement face 608 of the second pusher arm 601 is engaged behind the second screw 16*b*, whereby the screwstrip 14 is held in a position blocked against movement of the strip to the right relative the shuttle 96.

In the position in FIG. 23, the first screw 16*a* in sleeve 220*a* is axially in line with the axis 52 of the driver shaft ready for driving.

Figure 24:
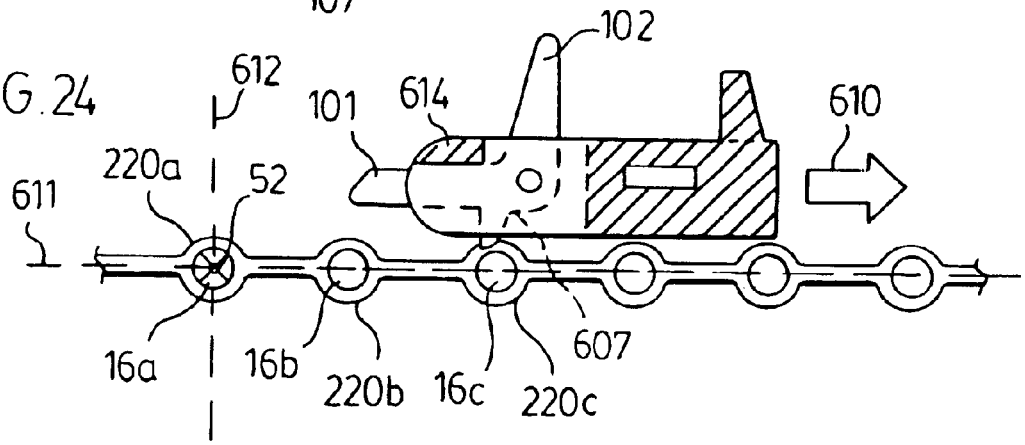
FIGS. 24 and 25 are views the same as FIG. 23 but with the shuttle being withdrawn in an intermediate position in FIG. 24 and in a fully withdrawn position in FIG. 25.

From the position of FIG. 23, in use of the tool, the lead screw 16*a* is driven from sleeve 220*a* and the shuttle 96 is withdrawn to the right passing through the position of FIG. 23 to assume the position of FIG. 24. Thus, as seen in FIG. 24, arrow 610 represents the withdrawal of the shuttle 96 relative the driver shaft and screwstrip 14.

From the position of FIG. 23 on movement of the shuttle 96 towards the right relative the screwstrip 14, it is to be appreciated that the camming surface 107 of the first arm 101 engages screw 16*b* and such engagement causes the pawl 99 to pivot about axis 100 against the bias of the spring. With further relative movement of the shuttle to the right, the camming surface 107 will continue to pivot the pawl 99 until the camming surface 607 comes to engage screw 16*c* and further pivot the pawl 99 so that the second arm 601 may pass to the left of the screw 16*c*. FIG. 24 illustrates the shuttle 96 as moving to the right as indicated by arrow 610 and with cam face 607 of the second pusher arm 601 engaging screw 16*c* in sleeve 220*c*.

The engagement of the cam faces with the screws pivots the pawl 99 against the bias of the torsional spring such that the pawl 99 may rotate clockwise. On the first pusher arm 101 moving to the right past screw 16*b* and the second pusher arm 601 moving to the right past screw 16*c*, the torsional spring urges the pawl 99 to rotate about post 100 so that the engagement faces 108 and 608 are positioned ready to engage the screws 16*b* and 16*c* and advance them to the left, indicated by arrow 613, as seen in FIG. 24.

FIG. 25 shows the shuttle 96 withdrawn rearwardly sufficiently to a position that the engagement faces 108 and 608 are to the right, rearward of the screws 16*b* and 16*c* in sleeves 220*b* and 220*c* and with the screw 16*a*, not seen, as it has been driven from the fractured sleeve 220*a*. From the position of FIG. 25, the shuttle 96 is moved to the left relative the axis 52 thereby advancing the screwstrip 14, moving it to the left and placing the screw 16*b* in the sleeve 220*b* into axial alignment with the driver shaft axis 52. In advance of the screwstrip 14, both the first and second pusher arms 101 and 601 engage their respective screws and urge the screwstrip 14 to advance.

Advantages of the pawl 96 described may be appreciated from U.S. Pat. No. 6,439,085, the disclosure of which is incorporated herein. Other pawl arrangements as taught in U.S. Pat. No. 5,934,162 with merely a single pusher arm 101 may be used.

The release arm 102 permits manual withdrawal of the screwstrip 14. A user may with his finger or thumb manually pivot the release arm 102 against the bias of spring so that both the first pusher arm 101 and its engagement face 108 and the second pusher arm 601 and its engagement face 608 are moved away from and clear of the screwstrip 14 whereby the screwstrip may manually be withdrawn as may be useful to clear jams or change screwstrips.

A fixed post 432 is provided on shuttle 96 opposed to the manual release arm 102 to permit pivoting of the release arm 102 by drawing the release arm 102 towards the fixed post 432 as by pinching them between a user's thumb and index finger.

The lever 48 couples to the shuttle 96 with the forward arm 54 of lever 48 received in the opening 98 of the shuttle 96. Sliding of the slide body 20 and the housing 18 in a cycle from an extended position to a retracted position and then back to an extended position results in reciprocal pivoting of the lever 48 about axle 50 which slides the shuttle 96 between the advanced and withdrawn position in its raceway 94 and, hence, results in the pawl 99 first retracting from engagement with a first screw to be driven to behind the next screw 16 and then advancing this next screw into a position to be driven.

Overview

The nose portion 24 carries the guide tube 75 with its screw locating guideway 82. The rear portion 22 carries the screw feed channel element 76 with its channelway 88, and screw feed advance mechanism with the reciprocating shuttle 96 and pawl 99 to advance the screwstrip 14 via the channelway 88 into the guideway 82. Each of the guideway 82, channelway 88 and shuttle 96 are preferably customized for screwstrips and screws or other fasteners of a corresponding size other than length. In this context, size includes shape, head diameter, shaft diameter, retaining strip configuration, spacing of screws along the retaining strip and the presence or absence of washes amongst other things. However, size does not, preferably, include a limitation to merely a single length since the preferred embodiments may drive screws having lengths from, for example, 3½ inches to 1½ inches without modifications. Different slide bodies are to be configured for different screwstrips and screws. Different modified slide bodies can be exchanged so as to permit the driver attachment to be readily adapted to drive different screwstrips and screws.

Many changes can be made to the physical arrangement of the nose portion 24 to accommodate different screws and fasteners. For example, the cross-sectional shape of the channelway 88 can be changed as can the diameter of the guideway 82. The length of the side walls 91 and 92 about the channelway 88 can be varied to accommodate different size screws which may require greater or lesser engagement.

The construction of the housing 18 and slide body 20 provide for a compact driver attachment.

The housing 18 includes side wall 301. The slide body 20 as best seen in FIG. 3 has a part cylindrical portion of a uniform radius sized to be marginally smaller than a part cylindrical inner surface of the side wall 301 of the housing 18. The side wall 301 extends circumferentially about the part cylindrical portion of the slide body 20 to retain the slide body 20 therein.

The housing has a flange portion 302 which extends radially from one side of the part cylindrical portion and is adapted to house the radially extending flange 46 of the rear portion 22 and the screw feed activation mechanism comprising the lever 48 and cam follower 62. The flange portion 302 is open at its front end and side to permit the screw feed channel element 76 to slide into and out of the housing 18. Concentrically located about the drive shaft 34 is the spring 38, the part cylindrical portions of the slide body 20, and the interior part cylindrical portions of the housing 18.

Depth Stop Mechanism

The driver attachment is provided with an adjustable depth stop mechanism which can be used to adjust the fully retracted position, that is, the extent to which the slide body 20 may slide into the housing 18. The adjustable depth stop mechanism is best seen in FIGS. 3 and 5.

A depth setting cam member 114 is secured to the housing 18 for rotation about a pin 116, shown in FIG. 5, parallel the longitudinal axis 52. The cam member 114 has a cam surface 115 which varies in depth, parallel the longitudinal axis 52, circumferentially about the cam member 114. A portion of the cam surface 115 is always axially in line with the rear end 117 of the front portion 24. By rotation of the cam member 114, the extent to which the front portion 24 may slide rearwardly is adjusted.

The extent the front portion 24 may slide into the housing 18 is determined by the depth of the cam member 114 axially in line with the rear end 117 of the nose portion 24 of slide body 20. The cam member 114 is preferably provided with a ratchet-like arrangement to have the cam member 114 remain at any selected position biased against movement from the selected position and with circular indents or depressions in the cam surface 115 to assist in positive engagement by the rear end 117 of the nose portion 24. A set screw 119, as seen in FIG. 3, is provided to lock the cam member 114 at a desired position and/or to increase resistance to rotation. The cam member 114 is accessible by a user yet is provided to be out the way and not interfere with use of the driver attachment. The depth stop mechanism controls the extent to which screws are driven into a workpiece and thus controls the extent of countersinking. Since the stop surface 117 is at a constant distance from the forwardmost surface 34 of the nose portion 24, and the bit 122 carried on the driver shaft 34 is in a constant position relative the housing, the depth stop mechanism will set the extent to which a screw is driven independent of the length of a screw and thus, when set, will drive or countersink the head of a screw of one length, say, 3½ inches, the same amount as the head of a screw of, say, 2 inches. While a rotatable cam member 114 is shown various other cam members may be provided to present a surface to be engaged by the rear end 117 of the front portion, including stepped members which can slide to present different surfaces.

The driver shaft 34 is shown in FIGS. 4 and 5 as carrying a split washer 120 engaged in an annular groove near its rear end 121 to assist in retaining the rear end of the driver shaft in the socket 27 of the housing 18. The driver shaft 34 is provided with a removable bit 122 at its forward end which bit can readily be removed for replacement by another bit as for different size screws. Such bits include sockets and the like and will preferably be of an outside diameter complementary to the inside diameter of the guideway 82.

Operation

Operation of the driver attachment is now explained with particular reference to FIGS. 4 and 5. As seen in FIG. 4, the screws 16 to be driven are collated to be held parallel and spaced from each other by the plastic retaining strap 13.

In operation, a screwstrip 14 containing a number of screws 16 collated in the plastic retaining strap 13 is inserted into the channelway 88 with the first screw to be driven received within the guideway 82. To drive the first screw into the workpiece 134, the power driver 11 is activated to rotate the driver shaft 34. The driver shaft 34 and its bit 122, while they are rotated, are reciprocally movable in the guideway 82 towards and away from the workpiece 134. In a driving stroke, manual pressure of the user pushes the housing 18 towards the workpiece 134. With initial manual pressure, the forward end of the nose portion 24 engages the workpiece 134 to compress spring 38 so as to move the nose portion 24 relative the rear portion 22 from the forward position shown in FIG. 4 to a rear position. The nose portion 24 is moved rearwardly until either a screw becomes sandwiched between the nose portion and the rear portion or the nose portion moves to the rear position relative the rear portion. Subsequently, the nose portion and rear portion move rearwardly from the extended position of the rear portion relative the housing to a retracted position relative the housing. On release of this manual pressure, in a return stroke, the compressed spring 38 moves the rear portion 22 back to its extended position relative the housing and the nose portion to its forward position relative the rear portion thereby moving the housing 18 and the driver shaft 34 away from the workpiece.

In a driving stroke, as the driver shaft 34 is axially moved towards the workpiece, the bit 122 engages the screw head 17 to rotate the first screw to be driven. As is known, the plastic strap 13 is formed to release the screw 16 as the screw 16 advances forwardly rotated by the driver shaft 34. In some cases with longer screws, the screw tip may engage in a workpiece before the head of the screw engages the strap such that engagement of the screw in the workpiece will assist in drawing the screw head through the strap to break the fragible straps, however, this is not necessary and a screw may merely, by pressure from the drive shaft, be released before the screw engages the workpiece. Preferably, on release of the screw 16, the plastic strap 13 deflects away from the screw 16 outwardly so as to not interfere with the screw 16 in its movement into the workplace. After the screw 16 is driven into the workpiece 134, the driver shaft 34 axially moves away from the workpiece under the force of the spring 38 and a successive screw 16 is moved via the screw feed advance mechanism from the channelway 88 through the access opening 86 into the guideway 82 and into the axial alignment in the guideway with the driver shaft 34.

The screw 16 to be driven is held in position in axial alignment with the driver shaft 34 with its screw head 17 abutting the side wall 83 in the guideway 82. As a screw 16 to be driven is moved into the cylindrical guideway 82, a leading portion of the strap 13 from which screws have previously been driven extends outwardly from the guideway 82 through the exit opening 87 permitting substantially unhindered advance of the screwstrip 14.

To assist in location of a screw to be driven within the guide tube 75, in the preferred embodiment with screws of certain lengths, the rear locating surface 125 and forward locating surface 432 engage the forward and rear surfaces 222 and 223 of the strap 13. Thus, on the bit 122 engaging the head of the screw and urging the screw forwardly, the screw may be axially located within the guide tube 75 by reason not only of the head of the screw engaging the side wall 83 of the guideway but also with the forward and rear surfaces 222 and 223 of the strap 13 being engaged in the locating surfaces 125 and 432 of the exitway 87.

The driver attachment 12 disclosed may be provided for different applications. In a preferred application, the driver may be used for high volume heavy load demands as, for example, as in building houses to apply sub-flooring and drywall. For such a configuration, it is preferred that with the power driver 11 comprising a typical screw gun which inherently incorporates a friction clutch and thus to the extent that a screw is fully driven into a workpiece, the clutch will, on the forces required to drive the screw becoming excessive, slip such that the bit will not be forced to rotate an engagement with the screw head and thus increase the life of the bit.

The driver attachment may be constructed from different materials of construction having regard to characteristics of wear and the intended use of the attachment. Preferably, a number of the parts may be moulded from nylon or other suitably strong lightweight materials. Parts which are subjected to excessive wear as by engagement with the head of the screw may be formed from metal or alternatively metal inserts may be provided within an injection moulded plastic or nylon parts. The optional provision of the nose portion 24 as a separate removable element has the advantage of permitting removable nose portions to be provided with surfaces which would bear the greatest loading and wear and which nose portions may be easily replaced when worn.

The screw feed advance mechanism carried on the nose portion has been illustrated merely as comprising a reciprocally slidable shuttle carrying a pawl. Various other screw feed advance mechanisms may be provided such as those which may use rotary motion to incrementally advance the screws. Similarly, the screws feed activation mechanism comprising the lever 48 and the cam follower have been shown as one preferred mechanism for activating the screw feed advance mechanism yet provide for simple uncoupling as between the shuttle 96 and the lever 48. Other screw feed activation means may be provided having different configurations of cam followers with or without levers or the like.

Screwstrip

In the preferred embodiment, the screwstrip 14 is illustrated as having screws extending normal to the longitudinal extension of the strap 13 and, in this context, the channelway 88 is disposed normal to the longitudinal axis 52. It is to be appreciated that screws and other fasteners may be collated on a screwstrip in parallel spaced relation, however, at an angle to the longitudinal axis of the retaining strip in which case the channelway 88 would be suitably angled relative the longitudinal axis so as to locate and dispose each successive screw parallel to the longitudinal axis 52 of the driver shaft.

A preferred collated screwstrip 14 for use in accordance with the present invention is as illustrated in the drawings and particularly FIGS. 1 and 4 and are substantially in accordance with Canadian Patent 1,054,982. The screwstrip 14 comprises a retaining strap 13 and a plurality of screws 16. The retaining strap 13 comprises an elongate thin band formed of a plurality of identical sleeves interconnected by lands 106. A screw 16 is received within each sleeve. Each screw 16 has a head 17, a shank 208 carrying external threads and a tip 15. As shown, the external threads extend from below the head 17 to the tip 15.

Each screw is substantially symmetrical about a central longitudinal axis 212. The head 17 has in its top surface a recess for engagement by the screwdriver bit.

Each screw is received with its threaded shank 208 engaged within a sleeve. In forming the sleeves about the screw, as in the manner for example described in Canadian Patent 1,040,600, the exterior surfaces of the sleeves come to be formed with complementary threaded portions which engage the external thread of the screw 16. Each sleeve has a reduced portion between the lands 106 on one first side of the strap 13. This reduced strength portion is shown where the strip extends about each screw merely as a thin strap-like portion or strap.

The strap 13 holds the screws 16 in parallel spaced relation a uniform distance apart. The strap 13 has a forward surface 222 and a rear surface 223. The lands 106 extend both between adjacent screws 16, that is, horizontally as seen in FIG. 4, and axially of the screws 16, that is, in the direction of the longitudinal axes 212 of the screws. Thus, the lands comprise webs of plastic material provided over an area extending between sleeves holding the screws and between the forward surface 222 and the rear surface 223. A land 106 effectively is disposed about a plane which is parallel to a plane in which the axes 212 of all the screws lies. Thus, the lands 106 comprise a web which is disposed substantially vertically compared to the vertically oriented screws as shown in the figures. The lands 106 and the sleeves, in effect, are disposed as continuous, vertically disposed strap 13 along the rear of the screws 16, that is, as a strap 13 which is substantially disposed about a plane which is parallel to a plane containing the axes of all screws.

A preferred feature of the screwstrip 14 is that it may bend to assume a coil-like configuration due to flexibility of the lands 106, such that, for example, the screwstrip could be disposed with the heads of the screws disposed into a helical coil, that is, the plane in which all the axes 212 of the screws lie may assume a coiled, helical configuration to closely pack the screws for use. Having the lands 106 and sleeves as a vertically extending web lying in the plane parallel that in which the axes 212 permits such coiling.

The invention is not limited to use of the collated screwstrips illustrated. Many other forms of screwstrips may be used such as the curved screwstrip illustrated in FIG. 24 of U.S. Pat. No. 5,927,163 to Habermehl and those illustrated in U.S. Pat. No. 3,910,324 to Nasiatka; U.S. Pat. No. 5,083,483 to Takaji; U.S. Pat. No. 4,019,631 to Lejdegard et al and U.S. Pat. No. 4,018,254 to DeCaro.

Access Opening

As seen in FIG. 3, the guide tube 75 has an outboard side which is partially cut away on its outboard side and has a continuous portion 382 of its outer wall which separates the screw access opening 86 from the exit opening 87 on the outboard side of the guide tube 75. As used herein, the outboard side is the side to which the strap 13 is deflected when a screw 16 is separated from the screwstrip 14.

To accommodate deflection of the strap 13 away from a screw 16 towards the outboard side, the passageway which extends from the screw access opening or entranceway 86 to the exit opening or exitway 87 is provided on its outboard side with a lateral strip receiving slotway 304 cut to extend to the outboard side from the cylindrical guideway 82. The slotway 304, as best seen in FIGS. 2 and 3, is bounded on the outboard side by side surface 306, at its forward end by ramped surface 308 and forward surface 125, and at its rear end by rear surface 312.

The access opening 86 forms an entranceway for the screwstrip 14 generally radially into the guideway 82 on one side. The exit opening 87 forms an exitway for portions of the strap 13 from which screws 16 have been driven, such portions being referred to as the spent strap 13.

The exit opening or exitway 87 is shown as adapted to encircle the spent strap 13 with the exitway 87 bordered by rearwardly directed forward surface 125, forwardly directed rear surface 432, side surface 444 and side surface 446.

As seen in FIG. 3, ramped surface 308 is an axially rearwardly directed surface which angles forwardly from the forward surface 125 towards the entranceway.

The ramped surface 308 extends forwardly from forward surface 125 with the ramped surface following the curvature of the side wall 83 as a ledge of constant width. The ramped surface 308 is useful to assist in driving the last screw from a strip as disclosed in U.S. Pat. No. 5,934,162 to Habermehl.

When the last screw 16 in a strap is located in the guideway, the fact that the exitway 86 encloses the spent strap 13 prevents the strap from rotating about the axis of the guideway to an orientation in which the screw 16 might be able to drop out of the guideway or the screw when driven is increasingly likely to jam. The spent strap 13 may extend from the exitway 87 at various angles limited only by the location of the side surfaces 314 and 316.

The configuration of FIG. 3 is advantageous to better ensure that the last screw 16 in any screwstrip 14 is driven and to generally assist in reducing the likelihood of any screw 16 being driven becoming jammed in the guideway with the strap 13.

Preferred strap segments for use with the drive attachment in accordance with this invention are, as shown in FIG. 1, segments of discrete length in which the axis of all straps lie in the same flat plane and in which the heads 17 of the screws are all located in a straight line.

Reference is made in FIGS. 1 and 3 to the slide stops 23 and 25 which are secured to the rear portion 22 and nose portion, respectively, of the slide body 20 by bolts 402 such that the slide stops 25 slide in longitudinal slots 40 on each side of housing 18 to independently key the nose portion and rear portion to the housing and to prevent each from being moved out of the housing past a fully extended position.

Protrusions on Nose Portion

The forwardmost contact surface 130 on the nose portion 24 is shown as comprising a smooth, relatively flat central surface 140 and a part spherical smooth surface 141 thereabout carrying a plurality of protrusions 142. The part spherical surface 141 is effectively a portion of a sphere of a radius centered on a point on axis 52. The surface 141 extends radially to the side and rearwardly but not forwardly.

A plurality of protrusions 142 are shown provided in an array on the surface 141. Each of the protrusions is shown as a spike-like member which extends at least partially forwardly from a base at the surface 141 to a distal end. Preferably, as shown, the protrusions extend from the surface 141 parallel to axis 52 about the base. Alternatively, the protrusions may extend normal to the surface 140. Each of the distal ends of the protrusions are preferably adapted to provide for increased frictional engagement with a work surface as is advantageous to prevent slippage.

As shown in FIG. 11, the forward distal ends of the protrusions 142 preferably have a forward extent which is rearward of the forwardmost contact surface 130. Thus, the protrusions 142 preferably are located such that they do not engage a flat surface of a workpiece when the axis 52 is normal the flat surface of the workpiece but are adapted to engage a workpiece when the axis is tilted to the surface of the work surfaces. The surface 130 and protrusions 142 may be provided as described in U.S. Pat. No. 6,425,306, the disclosure of which is incorporated herein by reference.

Figure 20:
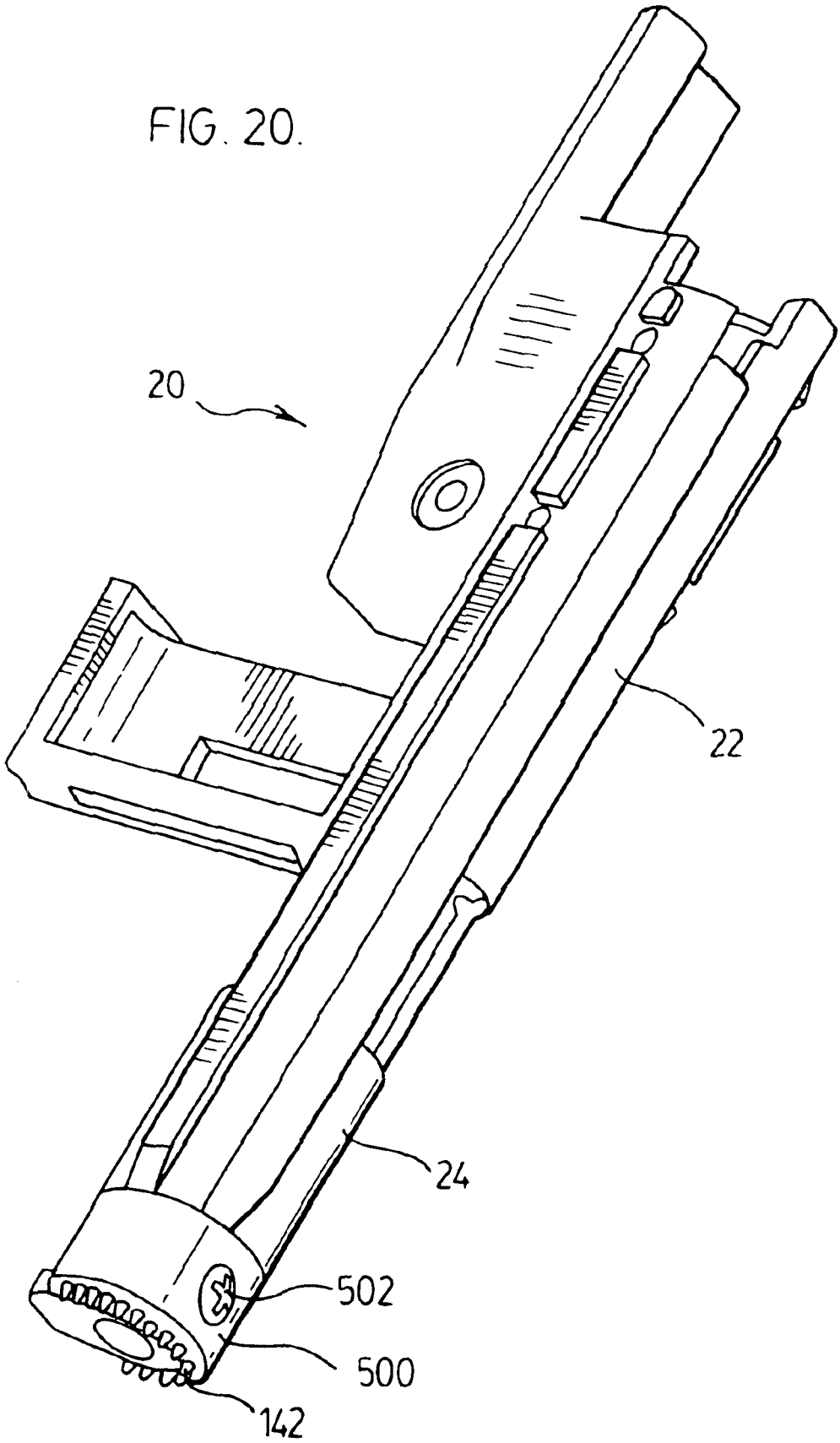
FIG. 20 is a pictorial view of a second embodiment of a slide body with a replaceable, invertible nose collar having protrusions extending forwardly.
Figure 21:
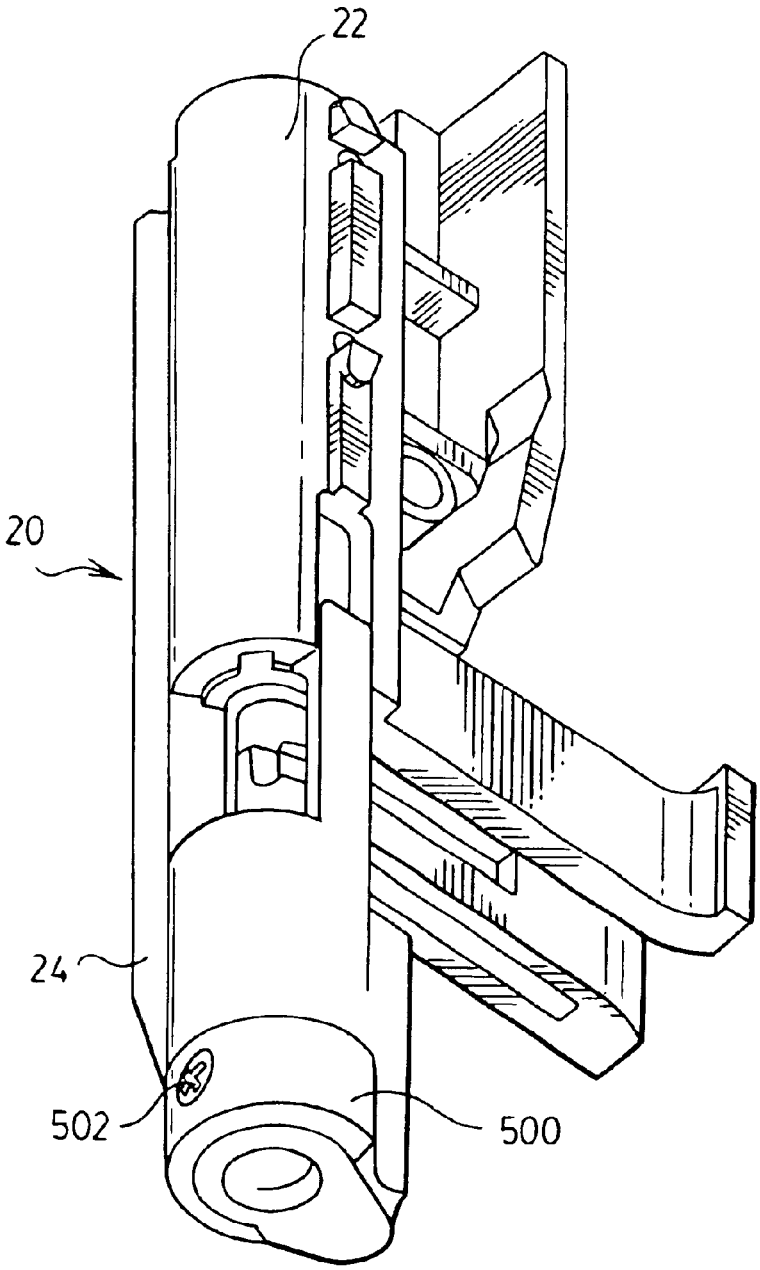
FIG. 21 is a pictorial view of the slide body of FIG. 20 with the nose collar replaced inverted to present a forward surface without protrusions.
Figure 22:
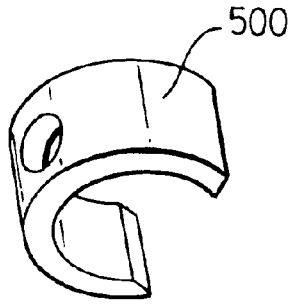
FIG. 22 is a pictorial view of the nose collar from FIG. 20.

References made to FIGS. 20, 21 and 22 will show a second embodiment of a slide body 20 in accordance with the present invention. The slide body of FIGS. 20 and 21 is effectively identical to that shown in the other Figures with the exception that the nose portion 24 has a removable C-shaped nose collar 500 which, in use, is fixably secured by a screw 502 about the front end of the nose portion 24. The C-shaped collar 500 is adapted to be removed and replaced by other C-shaped collars 500. The C-shaped collar shown in FIG. 20 is provided on one end with protrusions similar to those described with reference to FIGS. 1 to 6 and provided on another end with a smooth surface without protrusions. Insofar as these protrusions may wear over time, then a new C-shaped collar 500 may be secured to the tool.

The C-shaped collar, as seen in FIG. 22, may be inverted from the position shown in FIG. 20 to the position shown in FIG. 21 such that a user may select whether to use a nose portion 24 with protrusions as seen in FIG. 20 or a nose portion without protrusions as seen in FIG. 21. Of course, rather than have the C-shaped collar 500 capable of being inverted, it would be possible to merely provide two different C-shaped collars, one having protrusions and the other not having protrusions.

Various mechanisms could be provided to removably couple the C-shaped collars to the nose portion 24 and the use of a screw 502 is merely one embodiment.

The present invention has been described with reference to a nosepiece for an autofeed screwdriver. It is to be appreciated that a similar nose with a removable collar could be provided with tools of various types to drive fasteners including devices to drive a wide variety of different fasteners including screws and other threaded fasteners and nails, tacks, studs, posts and the like.

Notched Screwstrip

Figure 26:
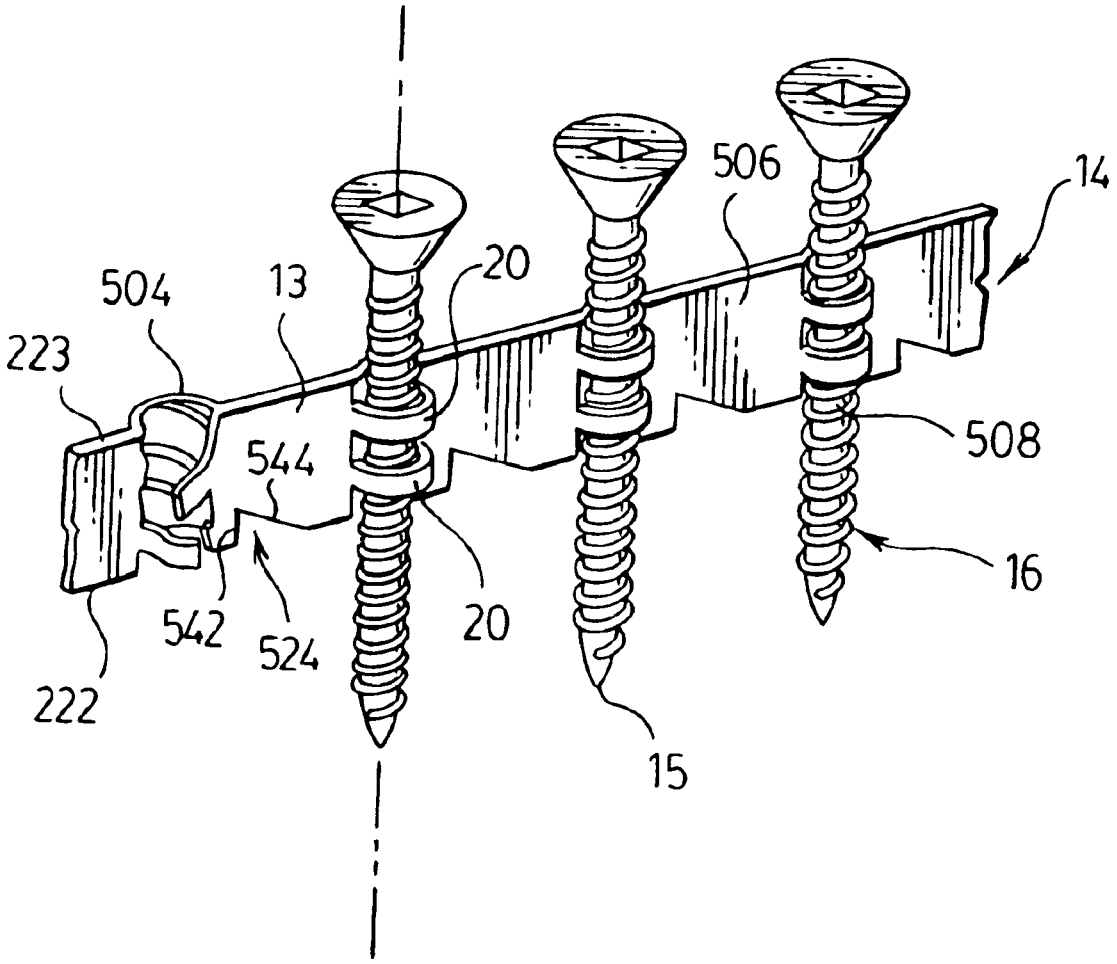
FIG. 26 is a perspective view of a screwstrip having locating notches or slots.
Figure 27:
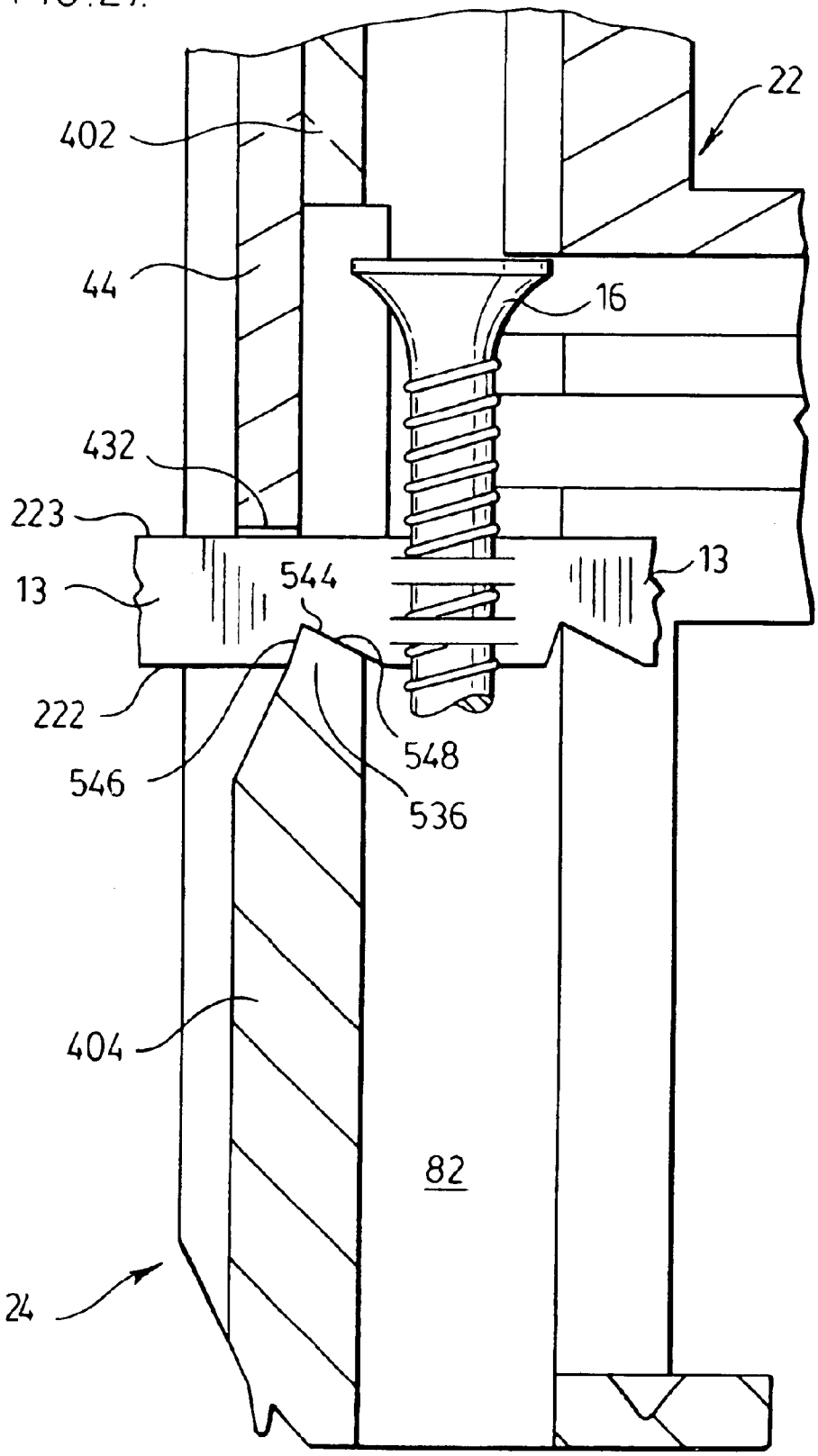
FIG. 27 is a view similar to that of FIG. 4 showing the slide body of FIGS. 1 to 19 modified for use with the notched screw strip of FIG. 26.

Reference is now made to FIGS. 26 and 27 which show another embodiment of the present invention in which the screwstrip carries a locating system to facilitate location of the screwstrip relative the guide tube 76. Such a screwstrip is described in U.S. Pat. No. 5,819,609, the disclosure of which is incorporated herein by reference.

FIG. 26 shows screws 16 held in a plastic holding strap 13 substantially in accordance with Canadian Patent 1,054,982, the disclosure of which is incorporated herein by reference. The strap comprises an elongate thin band formed of a plurality of identical sleeves 504 interconnected by lands 506. A screw 16 is received within each sleeve 504. Each screw 16 has a head 17, a shank 508 carrying external threads and a tip 15. As shown, the external threads extend from below the head 16 to the tip 116.

Each screw is substantially symmetrical about a central longitudinal axis. The head 17 has in its top surface a recess for engagement by the screwdriver bit 122.

Each screw is received with its threaded shank 508 engaged within a sleeve 504. In forming the sleeves about the screw in the manner, for example, as described in Canadian Patent 1,040,600, the exterior surfaces of the sleeves come to be formed with complementary threaded portions which engage the external thread of the screw 16. Each sleeve 504 has a reduced portion between the lands 506 on the first side of the strip and therefore on the first side of each screw. This reduced strength portion is shown as a substantially vertically extending longitudinal slot bridged by two thin strap-like portion or straps 120.

The strap 13 holds the screws 16 in parallel spaced relation a uniform distance apart. The strap has a forward surface 222 and a rear surface 223. Locating notches 524 are provided in the strap extending upwardly from the forward surfaces 222 with the notches 524 spaced from each other the same distance that the screws are spaced. Notches 524 are preferably formed at the same time that the strap is formed by an extrusion process which, in effect, captures the screws between two rotating forming wheels. The forming wheels may be modified so as to form the plastic strap with the suitably spaced notches.

The notches 524 are formed with a notch leading ramp-like engagement surface 542 and a notch trailing ramp-like engagement surface 544.

FIG. 27 shows an enlarged view of a nose portion 24 and rear portion 22 similar to the guide tube of FIGS. 1 to 19 but with the exitway 87 having its forward locating surface 125 of the nose portion 24 provide a tooth-like projection 536 which is shaped to correspond to the notches 524 in the strap.

As seen in FIG. 27, the forward locating surfaces comprise a projection leading ramp-like engagement surface 546 and a projection trailing ramp-like engagement surface 548 which define the projection 536 therebetween.

Engagement between trailing and/or leading surfaces of the projection and trailing and/or leading surfaces of the notch will cam the strip to move it to the left or the right to locate the notch precisely on the projection. Thus, the interaction between the surfaces of the projection and notch will move the strap transverse to the axis of the guide tube 75, that is, along the longitudinal direction of the strap 13.

In the context of a power screwdriver as shown in FIGS. 1 to 5, the feed pawl in each cycle on being moved to the right so as to be able to advance the next screw to the right of the pawl, to some extent, frictionally engages the strap 13 and its screws 16 and can draw the strap 13 back to the right. Such "feed pawl drawback" can be disadvantageous. However, with a notched screwstrip of FIG. 26, the engagement of the notch 524 and the projection 536 can advantageously avoid the disadvantage of the strap being drawn back by feed pawl drawback beyond a desired position with the screw in alignment with the bit. To avoid feed pawl drawback the projection leading surface 546 and the notch leading surface 542 may preferably be perpendicular to the longitudinal along the strip and thus parallel the drive shaft axis. Feed pawl drawback may be intentionally designed to occur and be utilized as a vehicle for ensuring positive location of the notch 524 on the projection 536.

In the preferred embodiments shown, the forward locating surface of the exitway 87 comprises surfaces of the projection 536 to engage notch 524 in the strap. The provision of projection 536 and uniformly spaced notches 524 are advantageous to form a system for locating the strap. The projection 536 and notches 524 may have different configurations. For illustration the projection and notch have been shown to extend about ⅓ the width of the strap. It is to be appreciated that smaller notches could readily be used. The notches and projections may have many other shapes than that shown.

The preferred embodiment shows forward locating surfaces of a projection 536 which is generally uniform in a direction transverse to the longitudinal of the strip. Forward locating surfaces and/or their projection 536 could be provided to vary in a direction transverse to the longitudinal to assist in locating the strap in a desired position in this direction. However, in the use of a screwstrip, it is to be appreciated that latitude needs to be given for the strap to deflect transversely to the longitudinal of the strap in the head of the screw forcing itself through the sleeve and past the strap.

Feed pawl drawback is advantageously reduced by the use of screwstrips with locating members to engage complementary locating members on the forward and/or rear locating surfaces 125 and 432. While complementary locating members are preferably on the forward locating surface 125 and the forward strap surface 222, they may also be provided on the rear locating surface 432 and the rear strap surface 223, or on both.

Feed pawl drawback is, in any event, without locating members on the strap or locating surfaces, avoided or reduced in the embodiment, for example, shown in FIGS. 15 to 19, insofar as the strap 13 is pinched between the forward locating surface 125 and the rear locating surface 432 to prevent movement of the strap transverse to the axis 52. Movement of the feed pawl, while the strap is adequately pinched, will not cause feed pawl drawback.

While the invention has been described with reference to preferred embodiments, many modifications and variations will now occur to persons skilled in the art. For a definition of the invention, reference is made to the appended claims.

We claim:

1. In combination, a screwdriver assembly to drive with a power driver, threaded screws from a screwstrip and, a screwstrip comprising a plastic holding strap holding screws spaced in side-by-side relation from each other, the strap having joining lands which extend both between the screws and axially relative the screws, the screwdriver assembly comprising:

a housing;

an elongate drive shaft for operative connection to a power driver for rotation thereby and defining a longitudinal axis;

a slide body coupled to the housing for displacement parallel to the axis of the drive shaft between a forwardmost extended position and a retracted position;

the slide body comprising:

a guideway to receive one screw of the screwstrip coaxially therein, a screwstrip entranceway opening generally radially into the guideway on a first side thereof, and a strap exitway opening generally radially out of the guideway on a second side thereof opposite the entranceway, the guideway, the entranceway and the exitway juxtapositioned to permit the screwstrip to be advanced through the entranceway radially into the guideway to locate each successive screw coaxially within the guideway with a portion of the strap from which screws have been driven extending from the guideway through the exitway, the slide body having a rear portion and a forward nose portion, the nose portion coupled to the rear portion for displacement parallel to the axis of the drive shaft between a forward position and a rear position;

the driver shaft having at a forward end a bit, the shaft relatively reciprocally movable axially in the guideway to engage with the bit a screw disposed coaxially within the guideway and drive the screw axially forwardly from the guideway into a workpiece, the rear portion carrying an axially, forwardly directed rear strap support surface axially in line with the exitway rear of the strap, the nose portion carrying an axially, rearwardly directed forward strap support surface axially in line with the exitway forward of the strap, wherein on sliding of the nose portion relative the rear portion towards the rear position, the strap in the exitway is clamped between the rear strap support surface and the forward strap support surface.

2. The combination as claimed in claim 1 the lands having a rearwardly directed rear surface and a forwardly directed forward surface, the strap clamped between the rear strap support surface and the forward strap support surface with the rear strap support surface engaging the rear surface of the lands and the forward strap support surface engaging the forward surface of the lands.

3. The combination as claimed in claim 2 wherein each screw extends about an axis and the lands extend between the screws as a web which extends both between adjacent screws and axially relative the screws disposed substantially about a plane parallel a plane containing the axes of all screws.

4. The combination as claimed in claim 3 wherein the strap further comprises spaced sleeves interconnected by lands with one of the screws received in each sleeve, each screw having a head at one rear end, a tip at the other forward end and a threaded shank extending from below the head to the tip, each screw received in each sleeve spaced a uniform distance from each adjacent screw with the screw's head extending from one rear end of the sleeve and the screw's tip extending from the other forward end of the sleeve, the sleeve threadably engaging the threaded shank, the sleeve having a reduced strength portion between the lands such that a screw on being threaded tip first into a workpiece is automatically separated from its sleeve while simultaneously maintaining the length of the strip substantially intact and while guiding the screw by threaded engagement of the screw in its respective sleeve.

5. The combination as claimed in claim 4 wherein the nose portion is keyed to the rear portion against relative rotation about the longitudinal axis.

6. A combination as claimed in claim 4 wherein the guideway comprises part cylindrical screw locating side wall with surfaces coaxially about the axis of the drive shaft of an inner diameter marginally greater than a diameter of a head of correspondingly sized screws to be received therein to engage the head of a screw and coaxially locate the screw in alignment with the drive shaft.

7. A combination as claimed in claim 4 wherein said rear portion of the slide body has a forwardly opening bore about said drive shaft, the bore having a forward open end;

said nose portion including a hollow, at least part tubular rearward extension forming a portion of the guideway therein, the rearward extension extending axially into the bore via the forward open end of the bore.

8. A combination as claimed in claim 4 wherein:

the guideway is adapted to receive fasteners having a screw head of a first diameter, the guideway having an inner diameter marginally greater than the first diameter, the guideway extending about the head of the fastener axially rearward of the exitway at least about 120 degrees.

9. A combination as claimed in claim 8 wherein the guideway extends about the head of the fastener about 180 degrees axially rearward of the exitway.

10. A screwstrip assembly as claimed in claim 4 wherein the forward strap support surface is fixed against movement relative to the remainder of the nose portion.

11. A combination as claimed in claim 4 wherein one of the forward strap support surface and the rear strap support surface includes support locating means to engage in registry with strap locating means on the strap to locate the strap in a desired position to assist in maintaining the screw coaxially disposed within the guideway.

12. A combination as claimed in claim 11 wherein the strap locating means comprises:

uniformly spaced notches on the forward surfaces of the lands of the strap extending rearwardly transverse to a longitudinal of the strap, and the support locating means comprises a rearwardly extending projection on the forward strap support surface complimentary to the notches to be received therein.

13. A combination as claimed in claim 12 wherein the projection or notches have ramp-like engagement surfaces which assist in disengagement of the projection and each successive notch by camming the strap rearwardly away from the forward strap support surface on advancing the strap through the exitway.

14. A combination as claimed in claim 13 wherein the ramp-like engagement surfaces include surfaces which assist in engagement of the projection and each successive notch in a desired juxtaposition by camming the strap to move transversely relative to the guideway on the strap being urged forwardly into the forward strap support surface.

15. A combination as claimed in claim 4 wherein the guideway engages the head of a screw received therein to assist in axially locating the head of the screw coaxially within the guideway.

16. A combination as claimed in claim 4 wherein the guideway extending entirely through the nose portion from a rearwardly opening rear opening to a forward opening, the rear portion includes a bore therethrough coaxially about the driver shaft and opening forwardly into the guideway via the rear opening, an elongate coil spring having a rear end and a forward end, the spring disposed coaxially about the driver shaft, the spring being axially slidable within the bore of the rear portion, the rear end of the spring engaging the housing and the forward end of the spring engaging the nose portion biasing the nose portion forwardly relative the housing and thereby biasing the nose portion forwardly relative the rear portion to the forward position and, with the nose portion in the forward position, biasing the entire slide body forwardly relative the housing.

17. A combination as claimed in claim 4 wherein:

the slide body resiliently biased forwardly relative to the housing parallel the axis and the nose portion resiliently biased forwardly relative to the rear portion parallel the axis.

18. The combination as claimed in claim 4 wherein the rear surface of the lands being spaced a constant distance forwardly from the head of each respective screw.

19. The combination as claimed in claim 18 wherein, the forward surface of the lands being spaced a constant distance forwardly from the head of each respective screw.

20. The combination as claimed in claim 4 wherein the strap holds the screws in a row spaced in side-by-side relation with the axes of the screws in a common plane, at least a portion of the strap holding the screws in a generally curved configuration wherein the heads of the fasteners lie on a first curve in the common plane and the tips of the fasteners lie in a corresponding second curve in the common plane of a greater radii.

21. A combination as claimed in claim 20 wherein the heads of the screws are disposed a constant distance from a center point in the common plane with the axes of the screws extending through the center point.

22. A combination as claimed in claim 2 wherein:

the forward strap support surface forming a forwardmost perimeter of the exitway, the rear strap support surface forming a rearwardmost perimeter of the exitway.

23. The combination as claimed in claim 1 wherein the rear portion having an elongate guide channel for said screwstrip extending through said rear portion generally transverse to the longitudinal axis and opening into the guideway via the entranceway.

24. The combination as claimed in claim 23 wherein the guide channel having a cross-section closely corresponding at least in part to that of the screwstrip received therein to constrain the strap and screws received therein against substantial movement other than longitudinally along the guide channel.

25. A combination as claimed in claim 24 including a screw feed advance mechanism carried by the rear portion to engage the screwstrip and successively, incrementally advance screws on the screwstrip through the guide channel into coaxial location in the guideway, a screw feed activation mechanism coupled between the rear portion of the slide body and the housing whereby displacement of the rear portion relative the housing between the extended position and the retracted position activates the screw feed activation mechanism to move the screw feed advance mechanism and thereby advance successive screws.

26. A combination as claimed in claim 25 wherein the screw feed activation mechanism includes cam surfaces on the housing and a cam follower carried by the rear portion.

27. A combination as claimed in claim 26 wherein the screw feed activation mechanism comprises: a lever pivotally mounted to the rear portion of the slide body means for pivoting about a pivot axis, the lever having a forward arm extending forwardly to couple with the screw feed advance mechanism, the lever means coupled to the cam follower whereby relative displacement of the housing and the rear portion translates into relative pivoting of the forward arm about the pivot axis.

28. A combination as claimed in claim 27 wherein the screw feed advance mechanism comprises a shuttle secured to the rear portion for reciprocal movement towards and away from the longitudinal axis.

29. A combination as claimed in claim 28 wherein the shuttle is slidable relative the rear portion in a direction parallel the guide channel and generally normal to both the longitudinal axis and the pivot axis.

30. A combination as claimed in claim 29 wherein the shuttle carries a paw to engage and advance the screwstrip in sliding of the shuttle towards the longitudinal axis.

31. A combination as claimed in claim 28 wherein the shuttle is reciprocally movable between an advanced and a retracted position, the pawl carried by the shuttle to engage the screwstrip to advance the screwstrip within the guide channel on movement of the shuttle from the retracted position to the advanced position.

32. A combination as claimed in claim 27 wherein the lever having a rear arm extending rearwardly to a rear end with the cam follower carried on the rear end of the rear arm.

* * * * *

UNITED STATES PATENT AND TRADEMARK OFFICE

CERTIFICATE OF CORRECTION

PATENT NO. : 6,862,963 B2
APPLICATION NO. : 10/291248
DATED : March 8, 2005
INVENTOR(S) : Habermehl et al.

It is certified that error appears in the above-identified patent and that said Letters Patent is hereby corrected as shown below:

Col. 30, line 23: after "a" and before "to", delete "paw" and substitute therefore --pawl--.

Signed and Sealed this

Third Day of October, 2006

JON W. DUDAS
*Director of the United States Patent and Trademark Office*